US009747885B2

(12) United States Patent
Goto et al.

(10) Patent No.: US 9,747,885 B2
(45) Date of Patent: Aug. 29, 2017

(54) NOISE REDUCTION SYSTEM

(71) Applicant: Kabushiki Kaisha Toshiba, Minato-ku (JP)

(72) Inventors: Tatsuhiko Goto, Kawasaki (JP); Osamu Nishimura, Kawasaki (JP); Akihiko Enamito, Kawasaki (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 15/066,112

(22) Filed: Mar. 10, 2016

(65) Prior Publication Data

US 2016/0284338 A1 Sep. 29, 2016

(30) Foreign Application Priority Data

Mar. 26, 2015 (JP) ..... 2015-065115

(51) Int. Cl.
*G10K 11/178* (2006.01)

(52) U.S. Cl.
CPC .... *G10K 11/178* (2013.01); *G10K 2210/1161* (2013.01); *G10K 2210/3016* (2013.01); *G10K 2210/3028* (2013.01)

(58) Field of Classification Search
CPC ..... A61B 5/7203; A61B 2018/00642; A61B 2562/0204; A61B 2562/0247;
(Continued)

(56) References Cited

U.S. PATENT DOCUMENTS 5,694,475 A 12/1997 Boyden
6,463,316 B1 * 10/2002 Brungart ..... A61B 5/055 381/71.1

(Continued)

FOREIGN PATENT DOCUMENTS

JP 5-297879 A 11/1993
JP 6-217961 A 8/1994

(Continued)

OTHER PUBLICATIONS

Yoichi Hinamoto, et al., "Analysis of Linear and Nonlinear Filtered-X LMS Algorithms for Active Control of Multitonal Noise" Technical Report of IEICE, The Institute of Electronics, Information and Communication Engineers, vol. 103, No. 547, 2004, pp. 59-64.

*Primary Examiner* — Mohammad Islam
(74) *Attorney, Agent, or Firm* — Oblon, McClelland, Maier & Neustadt, L.L.P.

(57) ABSTRACT

According to one embodiment, a noise reduction system for reducing noise including impact noise repetitively generated at a time interval includes the following elements. The error signal generator generates an error signal based on the noise being detected. The delay signal generator has a time delay characteristic and delays a signal, which is generated based on the error signal, to generate a delay signal, the time delay characteristic being determined based on an imaging sequence or pre-scanning by the MRI device and corresponding to the time interval. The control filter generates the first control signal from the delay signal. The loudspeaker unit includes at least one pair of a first filter and a control loudspeaker and a transmission unit.

13 Claims, 31 Drawing Sheets

(58) Field of Classification Search
CPC ..... A61B 5/0035; G10K 11/178; G10K 2210/1161; G10K 11/1788; G10K 2210/1081; G10K 2210/3016; G10K 2210/3028; G10K 2210/3026
USPC ..... 381/71.2, 71.8
See application file for complete search history.

(56) References Cited

U.S. PATENT DOCUMENTS

2005/0270029 A1 12/2005 Ehman et al.
2006/0253020 A1 11/2006 Ehman et al.
2007/0223714 A1* 9/2007 Nishikawa ..... G10K 11/1788 381/71.1
2010/0111325 A1* 5/2010 Matsuo ..... H04R 3/005 381/92
2010/0188208 A1* 7/2010 Fisher ..... G06F 1/163 340/539.12
2011/0158426 A1* 6/2011 Matsuo ..... H04R 3/005 381/92
2012/0134509 A1* 5/2012 Matsumoto ..... G10L 21/0208 381/94.3
2013/0166286 A1* 6/2013 Matsumoto ..... G10L 21/02 704/205
2014/0098968 A1* 4/2014 Furuta ..... G10K 11/16 381/71.12
2014/0200886 A1* 7/2014 Matsumoto ..... G10L 21/0208 704/226
2014/0241546 A1* 8/2014 Matsumoto ..... H04R 3/04 381/86
2015/0086031 A1* 3/2015 Goto ..... G10K 11/178 381/71.8
2015/0088494 A1* 3/2015 Matsumoto ..... G10L 21/0232 704/205
2015/0172813 A1* 6/2015 Goto ..... G10K 11/1784 381/71.1
2015/0271603 A1 9/2015 Goto et al.

FOREIGN PATENT DOCUMENTS

JP 2819252 B2 8/1998
JP 3038243 B2 2/2000
JP 2007-327980 A 12/2007
JP 2009-195649 A 9/2009
JP 4885129 B2 12/2011
JP 5047537 B2 7/2012
JP 2015-65512 A 4/2015
JP 2015-179118 A 10/2015

* cited by examiner

NOISE REDUCTION SYSTEM

CROSS-REFERENCE TO RELATED APPLICATIONS

This application is based upon and claims the benefit of priority from Japanese Patent Application No. 2015-065115, filed Mar. 26, 2015, the entire contents of which are incorporated herein by reference.

FIELD

Embodiments described herein relate generally to a noise reduction system.

BACKGROUND

As a method of reducing noise, ANC (active noise control) is known. ANC outputs a signal (control sound) having the same amplitude and an opposite phase as compared with noise from a control loudspeaker in order to reduce noise. As a basic technique for ANC, a technique called Filtered-x is known. ANC techniques are roughly classified into two types: a feedforward type and a feedback type.

An MRI (Magnetic Resonance Imaging) device generates very large repetitive impact noise because the device applies a slice selection gradient field for each TR (Repetition Time) in which an MR (Magnetic Resonance) signal is detected. Such impact noise has a high contribution ratio in noise generated by the MRI device. Since the MRI device is a strong magnetic field generator, a control loudspeaker that is a magnetic body cannot be arranged in the MRI device. In feedforward ANC, the distance between a control loudspeaker and an error microphone for evaluating a control effect needs to be shorter than that between a reference microphone for acquiring noise and the error microphone. For this reason, it is impossible to apply feedforward ANC to an MRI device in which a control loudspeaker cannot be arranged.

General feedback ANC is a technique of generating a control signal based on the latest detection signal, and hence can reduce only periodic noise in principle. When, therefore, feedback ANC is applied to an MRI device, the device can reduce periodic noise caused by the vibration of the gradient coil when performing phase encoding or reading, but cannot reduce impact noise generated for each TR.

DETAILED DESCRIPTION

Figure 1:
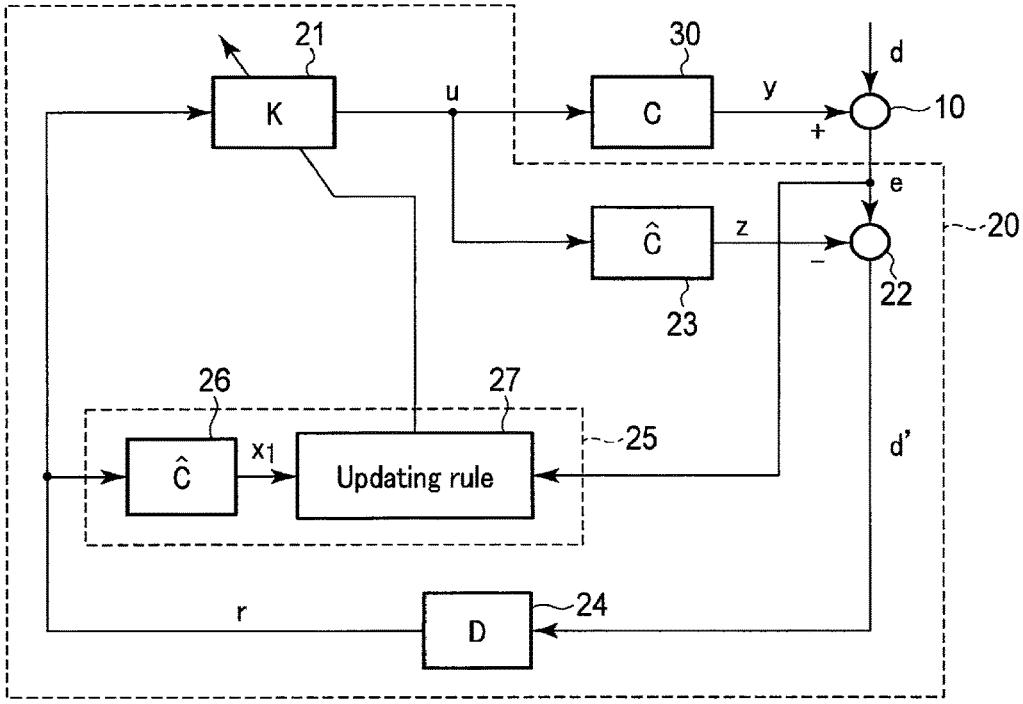
FIG. 1 is a block diagram for explaining a basic scheme for a noise reduction technique according to an embodiment.

According to one embodiment, there is provided a noise reduction system for reducing noise generated from an MRI device and including impact noise repetitively generated at a time interval. The noise reduction system includes an error signal generator, an estimated noise generator, a delay signal generator, a control filter, and a loudspeaker unit. The error signal generator generates an error signal based on the noise being detected. The estimated noise generator generates an estimated noise signal based on the error signal and a first control signal, the estimated noise signal indicating an estimate of a sound pressure of the noise. The delay signal generator has a time delay characteristic and delays the estimated noise signal to generate a delay signal, the time delay characteristic being determined based on an imaging sequence or pre-scanning by the MRI device and corresponding to the time interval. The control filter generates the first control signal from the delay signal. The loudspeaker unit includes at least one pair of a first filter and a control loudspeaker and a transmission unit, the first filter generating a second control signal from the first control signal, the control loudspeaker converting the second control signal into a sound wave to output a control sound, the transmission unit transmitting the control sound.

Embodiments will be described below with reference to the accompanying drawings. In the following embodiments, the like reference numerals denote the like elements, and a repetitive description will be omitted.

A basic scheme for a noise reduction system according to an embodiment will be described first.

In the noise reduction system according to the embodiment, a time interval in which impact noise is generated (referred to as an impact noise interval hereinafter) is incorporated as a time delay element in feedback ANC. In principle, this is equivalent to use the latest impact noise signal as a reference signal in feedback ANC. Therefore, impact noise can be reduced.

The noise reduction system according to the embodiment can be applied to a noise generator which repetitively generates impact noise. In the embodiment, impact noise is noise generated abruptly such as an impact sound generated by impact between mechanical elements. A noise generator is, for example, an MRI device. The embodiment will exemplify a case in which the noise reduction system is applied to an MRI device. The MRI device applies a slice selection gradient magnetic field for each repetition time (TR) at which an MR signal is detected, and generates impact noise along with the application. Specifically, when the device switches a current flowing in the gradient coil to apply a slice selection gradient magnetic field, the gradient coil receives the Lorentz force and instantly vibrates. This generates a large sound from the gradient coil. In addition, the MRI device generates periodic noise by the vibration of the gradient coil at the time of phase encoding or reading. Periodic noise is noise having a specific frequency such as a sinusoidal signal.

In the embodiment, an impact noise interval MTR [sec] is determined in advance. An impact noise interval often corresponds to a repetition time of an imaging sequence. In this case, it is possible to determine an impact noise interval from an imaging sequence input to the MRI device. When an impact noise interval does not correspond to the repetition time of an imaging sequence, an impact noise interval can be determined from pre-scanning. Even if an impact noise interval changes instead of being fixed, such a case can be handled by storing changing timings in the form of a database in advance based on pre-scanning. Even if the interval changes, since the change is small, providing an initial impact noise interval makes it possible to obtain a sufficient effect of reducing impact noise.

FIG. 1 schematically shows the noise reduction system according to the embodiment. The noise reduction system shown in FIG. 1 includes an error microphone (corresponding to an error signal generator) 10 which detects a sound containing noise generated from the MRI device to generate an error signal e, a control signal generator 20 which generates a control signal u for canceling the noise based on the error signal e, and a loudspeaker unit 30 which generates a control sound based on the control signal u. Referring to FIG. 1, noise at the error microphone 10 is represented by d, a control sound at the error microphone 10 is represented by y, and a secondary path characteristic indicating a path characteristic from the control signal u to the error microphone 10 is represented by C. The secondary path characteristic C corresponds to the path characteristic of the loudspeaker unit 30.

Since the MRI device is a strong magnetic field environment and has a narrow space, no loudspeaker can be arranged inside the MRI device. For this reason, a sound transmission system obtained by combining loudspeakers and tubes is used in the embodiment. Each tube is a hollow tube which can transmit or propagates a sound wave. For example, each loudspeaker is arranged outside a room in which the MRI device is installed, and a control sound is guided to the error microphone 10 via each tube. The error microphone 10 is installed near, for example, the bore of the MRI device. When using the tube, a difference is likely to occur between the frequency characteristic of an input signal (i.e., the control signal u) and the frequency characteristic of an output (i.e., the control sound y). For this reason, for the loudspeaker unit 30, it is preferred that the difference between the frequency characteristic of an input signal and the frequency characteristic of an output signal is reduced. In addition, as the length of each tube increases, the sound pressure of the control sound y decreases. The structure of the loudspeaker unit 30 will be described later.

The control signal generator 20 includes a control filter 21, a subtractor 22 corresponding to an estimated noise signal generator, a secondary path filter 23, a delay filter 24, and a filter updating unit 25. The secondary path filter 23 has an estimated secondary path characteristic a as an estimate of the secondary path characteristic $\hat{C}$, and converts the control signal u in accordance with the estimated secondary path characteristic $\hat{C}$ to generate an estimated control signal z. The estimated secondary path characteristic $\hat{C}$ is determined based on a result of identifying the secondary path characteristic C in advance. The estimated control signal z indicates the estimate of the sound pressure of the control sound y. The subtractor 22 subtracts the estimated control signal z from the error signal e to generate an estimated noise signal d'. The estimated noise signal d' indicates the estimate of the sound pressure of noise d.

The delay filter 24 has a time delay characteristic D based on the impact noise interval MTR, and converts the estimated noise signal d' in accordance with the time delay characteristic D to generate a delay signal r. In other words, the delay filter 24 delays the estimated noise signal d' by the time delay characteristic D. The control filter 21 generates the control signal u from the delay signal r. The control filter 21 is, for example, an adaptive filter with a control characteristic K, and converts the delay signal r in accordance with the control characteristic K to generate the control signal u.

The filter updating unit 25 adaptively updates the adaptive filter of the control filter 21 so as to reduce the error signal e. The filter updating unit 25 includes an auxiliary filter 26 and an updating unit 27. The auxiliary filter 26 has the estimated secondary path characteristic $\hat{C}$, and converts the delay signal r in accordance with the estimated secondary path characteristic $\hat{C}$ to generate an auxiliary signal $x_1$. The updating unit 27 adaptively updates the adaptive filter of the control filter 21 by using the error signal e and the auxiliary signal $x_1$. The filter updating unit 25 performs updating in accordance with an updating rule such as an LMS (Least Mean Square) algorithm or NLMS (Normalized LMS) algorithm. The LMS algorithm and the NLMS algorithm are used in Filtered-x.

Figure 2:
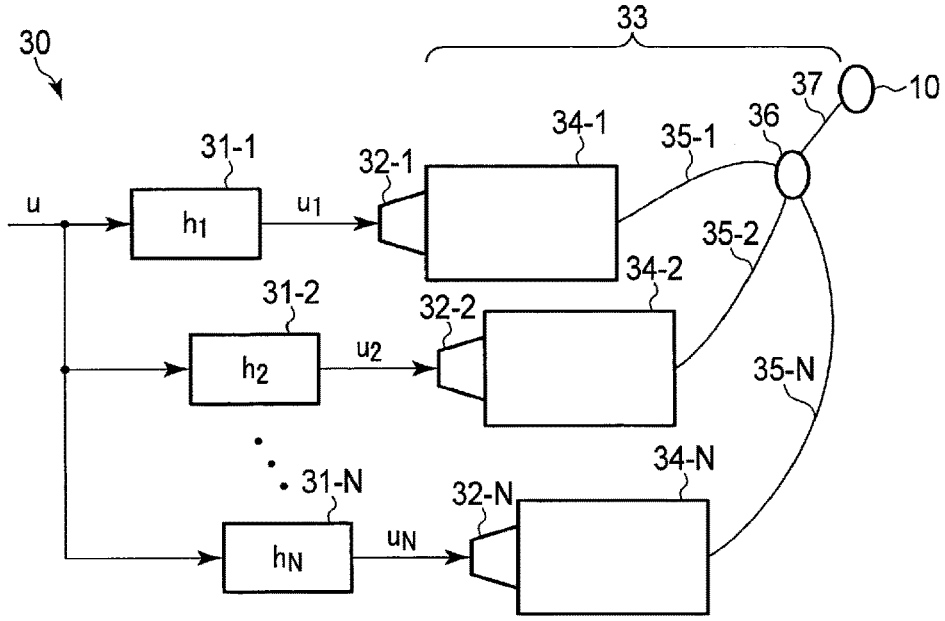
FIG. 2 is a block diagram showing an example of a loudspeaker unit according to an embodiment.

FIG. 2 schematically shows an example of the loudspeaker unit 30. As shown FIG. 2, the loudspeaker unit 30 includes filters 31-1, 31-2, . . . , 31-N which convert the control signal u in accordance with filter characteristics $h_1$, $h_2$, . . . , $h_N$ to generate control signals $u_1$, $u_2$, . . . , $u_N$, control loudspeakers 31-1, 32-2, . . . , 32-N which convert the control signals $u_1$, $u_2$, . . . , $u_N$ into sound waves (control sounds), and a transmission unit 33 which transmits the control sounds generated from the control loudspeakers 32-1, 32-2, . . . , 32-N, where N is an integer equal to or more than 1. The transmission unit 33 includes resonance boxes 34-1, 34-2, . . . , 34-N to which the control loudspeakers 32-1, 32-2, . . . , 32-N are attached, a sound collection unit 36 connected to the resonance boxes 34-1, 34-2, . . . , 34-N via tubes 35-1, 35-2, . . . , 35-N, and a tube 37 connected to the sound collection unit 36. For example, the distal end of the tube 37 is arranged near the bore of the MRI device. The error microphone 10 is arranged near the distal end of the tube 37. This makes it possible to reduce noise reaching a subject located in the bore of the MRI device. If N=1, the sound collection unit 36 need not be provided.

A resonance box 34-*i* is a sealed box-like member having an internal space, where i is an integer equal to or more than 1. A control loudspeaker 32-*i* is fixed to the resonance box 34-*i* so as to generate a sound wave in the internal space of the resonance box 34-*i*. A hole is formed in a side wall of the resonance box 34-*i*. A tube 35-*i* is attached to this hole. The tube 35-*i* connects the resonance box 34-*i* to the sound collection unit 36. As this tube, for example, a flexible tube formed from a flexible material such as a resin can be used. The sound collection unit 36 combines control sounds generated from the control loudspeakers 32-1, 32-2, . . . , 32-N. The tube 37 then transmits the composite control sound to the error microphone 10 and the subject.

In the case shown in FIG. 2, one control loudspeaker 32 is attached to each resonance box 34. A plurality of control loudspeakers 32 may be attached to any of the resonance boxes 34. For example, the control loudspeaker 32-1 is attached to the resonance box 34-1, and the control loudspeakers 32-2 and 32-3 are attached to the resonance box 34-2. In addition, at least one of the control loudspeakers 32-1, 32-2, . . . , 32-N may be directly connected to a tube 35 without via the tube resonance box 34. Note however that when the control loudspeaker 32 is directly connected to the tube 35, a sound sometimes leaks from a connection portion between the control loudspeaker 32 and the tube 35. Connecting the control loudspeaker 32 to the tube 35 via the resonance box 34 can effectively suppress such sound leakage. Furthermore, using a sound resonance phenomenon caused by the resonance box 34 can increase the sound pressure of the control sound y.

If N is 2 or more, the filters 31-1, 31-2, . . . , 31-N are designed to satisfy, for example, equation (1):

$$\sum_{i=1}^{N} h_i g_i = D \tag{1}$$

where $h_i$ represents the filter characteristic of a filter 31-*i*, $g_i$ represents the path characteristic from the input (control signal $u_i$) of a loudspeaker 32-*i* to the error microphone 10, and D represents a target transmission characteristic from the input signal to an output signal. Path characteristics $g_1$, $g_2$, . . . , $g_N$ are measured in advance. The path characteristics $g_1$, $g_2$, . . . , $g_N$ are designed to be different from each other.

In general, the target transmission characteristic D is preferably a flat frequency characteristic throughout an overall frequency band. In practice, however, in consideration of the characteristics of the loudspeaker itself or spatial characteristics, a target transmission characteristic is set so as to have a flat frequency characteristic in a specific frequency band. In addition, in general, noise to be reduced by the noise reduction system is a low-frequency wave, and hence a target transmission characteristic may be set so as to have a flat characteristic from 100 Hz to 2 kHz. In this manner, a target transmission characteristic is set depending on the situation.

If filter characteristics $h_1$, $h_2$, . . . , $h_N$ of the filters 31-1, 31-2, . . . , 31-N satisfy equation (1), the transmission characteristic from the input signal to the output signal coincides with the target transmission characteristic. As a method of obtaining the filter characteristics $h_1$, $h_2$, . . . , $h_N$ satisfying equation (1), for example, a technique like MINT (multiple-input/output inverse-filtering theorem) can be used. A method of designing the filters 31-1, 31-2, . . . , 31-N is not limited to the method using MINT, and may be another arbitrary method. For example, it is possible to use the design method disclosed in JP-A 2014-174345 (KOKAI).

Note that some of the filter characteristics $h_1$, $h_2$, . . . , $h_N$ may be set to a through characteristic. The filter 31-*i* having the through characteristic outputs the control signal u to the loudspeaker 32-*i* without any change.

If N is 1, that is, one control loudspeaker 32-1 is provided, the filter characteristic $h_1$ of the filter 31-1 is set to an approximate inverse characteristic of the path characteristic $g_1$. In this case, the transmission characteristic from the input signal to the output signal deviates from the target transmission characteristic. Alternatively, the filter characteristic $h_1$ of the filter 31-1 may be set to a through characteristic.

As described above, in the loudspeaker unit 30, the filter characteristics $h_1$, $h_2$, . . . , $h_N$ of the filters 31-1, 31-2, . . . , 31-N are determined to make the path characteristic from the input signal to the output signal coincide with the target transmission characteristic. This can reduce the difference between the frequency characteristic of the input signal and the frequency characteristic of the output signal.

An example of the design of the loudspeaker unit 30 when N=2 will be described. The dimensions of the resonance box 34-1 are 0.21 m×0.24 m×0.33 m, the loudspeaker position is (0.14, 0.23999, 0.11), and the tube position is (0.00001, 0.23999, 0.32999). The origin of the coordinate system is set to one of the corners of the resonance box. The dimensions of the resonance box 34-2 are 0.141 m×0.165 m×0.51 m, the loudspeaker position is (0.094, 0.16499, 0.17), and the tube position is (0.00001, 0.16499, 0.50999). The loudspeaker position indicates the position of the cone of the control loudspeaker 32. In this case, values whose reciprocals are about 2, 3, 4, 5, 6, and 7 are allocated to the dimensions of the resonance boxes 34-1 and 34-2 in consideration of the natural angular frequency of each resonance box represented by equation (2) given below:

$$\omega_{n_x,n_y,n_z} = c\pi\sqrt{(n_x/l_x)^2+(n_y/l_y)^2+(n_z/l_z)^2} \tag{2}$$

With this operation, the influences of the respective sides on natural angular frequencies change. This can increase the number of natural angular frequencies. In addition, the dimensions are not perfect reciprocals, but multiples of 3 are allocated, considering that the control loudspeaker is placed at a position corresponding to ⅓ of the side. This setting is made to excite a mode function $\phi_n$ in a transmission characteristic P of a sound pressure as indicated by equations (3) and (4) given below at all the natural angular frequencies.

$$P(\omega) = \left\{ j\omega\rho c^2 \sum_n \frac{\phi_n(x_1)\phi_n(x_2)}{\varepsilon_n(\omega_n^2 - \omega^2 + 2j\beta\omega)} \right\} \Big/ \langle l_x l_y l_z \rangle \tag{3}$$

$$\phi_n = \cos(x\pi n_x / l_x)\cos(x\pi n_y / l_y)\cos(x\pi n_z / l_z) \tag{4}$$

This setting excites each mode to a lower degree than a case in which the control loudspeaker 32 is installed at the corner of the resonance box, but excites all the modes. In addition, since the resonance boxes 34-1 and 34-2 excite different modes, combining the resonance boxes 34-1 and 34-2 will increase the mode density as a whole.

The tubes 35-1 and 35-2 respectively have lengths of 4 m and 6 m. These lengths are set in consideration of conduit resonance. That is, the length of 4 m causes conduit resonance at every 42.5 Hz, and the length of 6 m causes conduit resonance at every 28.3 Hz, thereby displacing the notch characteristics.

Figure 3:
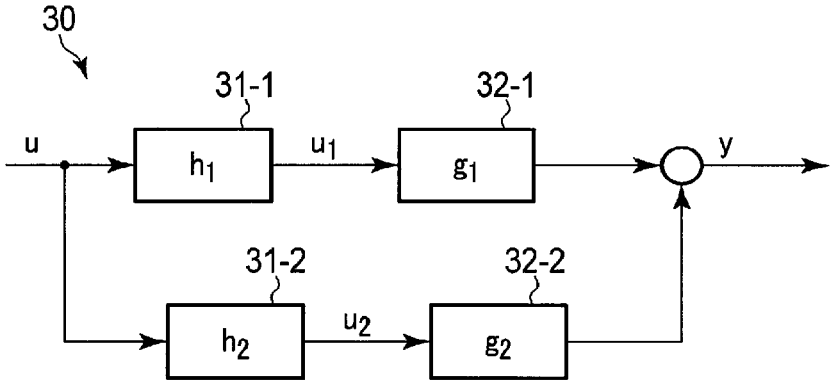
FIG. 3 is a block diagram showing a loudspeaker unit including two control loudspeakers according to an embodiment.

The noise reduction system having the above structure can reduce repetitive impact noise. The following is a detailed description of updating processing by the control signal generator 20 in each of the first to sixth embodiments. As shown in FIG. 3, the loudspeaker unit 30 includes two pairs of digital filters and control loudspeakers.

First Embodiment

The first embodiment will exemplify an inverse filter system with a delay.

Figure 4:
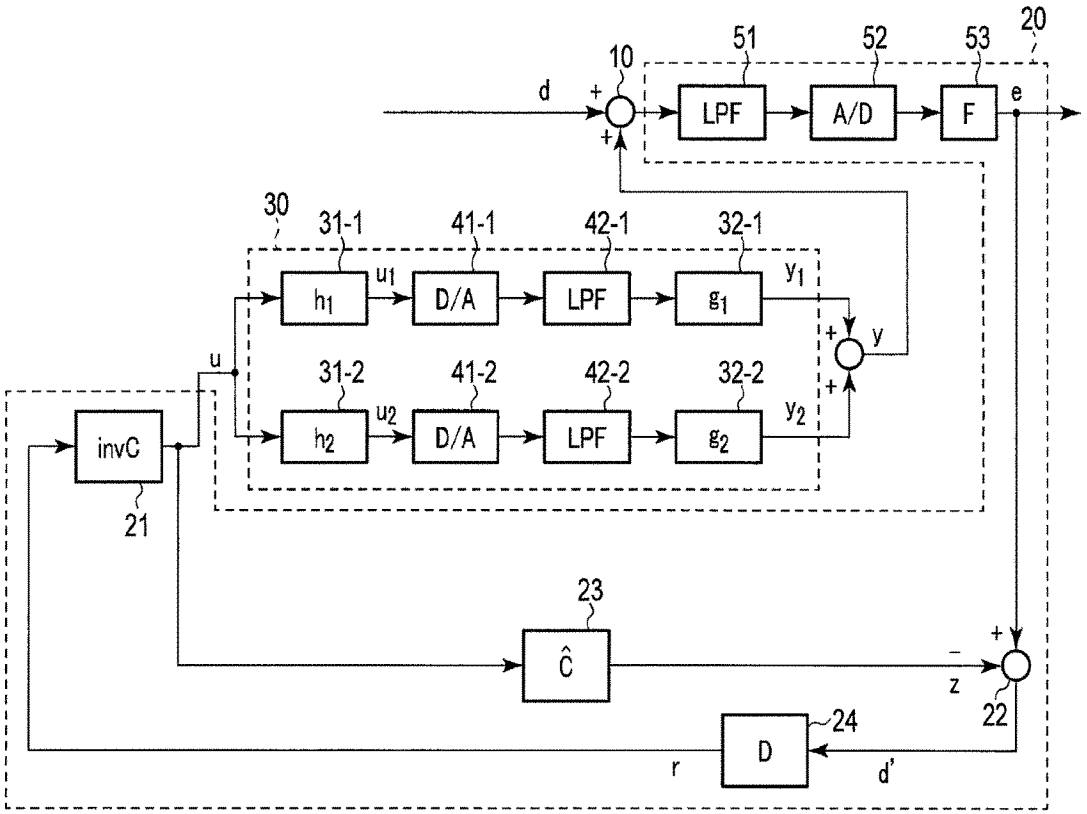
FIG. 4 is a block diagram showing a noise reduction system according to the first embodiment.

FIG. 4 schematically shows a noise reduction system according to the first embodiment. The noise reduction system shown in FIG. 4 includes an error microphone 10, a control signal generator 20, and a loudspeaker unit 30. The loudspeaker unit 30 includes digital filters 31-1 and 31-2, control loudspeakers 32-1 and 32-2, and a transmission unit 33 (not shown in FIG. 4). A digital/analog (D/A) converter 41-1 which converts a control signal $u_1$ into an analog signal and a low-pass filter (LPF) 42-1 for signal interpolation are provided between the filter 31-1 and the control loudspeaker 32-1. A digital/analog (D/A) converter 41-2 which converts a control signal $u_2$ into an analog signal and a low-pass filter (LPF) 42-2 for signal interpolation are provided between the filter 31-2 and the control loudspeaker 32-2. In FIG. 4, $y_1$ is a control sound at the error microphone 10 which is output from the control loudspeaker 32-1, and $y_2$ is a control sound at the error microphone 10 which is output from the control loudspeaker 32-2.

The error microphone 10 converts sounds including noise from the MRI device and control sounds from the control loudspeakers 32-1 and 32-2 into an electrical signal to generate an error signal e. The error signal e passes through an LPF 51 and is converted into a digital signal by an analog/digital (A/D) converter 52. The digital signal then passes through a bandpass filter 53. The LPF 51 is provided for an anti-aliasing measures. The bandpass filter 53 is provided for adjusting a frequency band to be controlled. Changing the band of the bandpass filter 53 can change the frequency band to be controlled.

The control signal generator 20 includes a control filter 21, a subtractor 22, a secondary path filter 23, and a delay filter 24. A noise reduction system can reduce impact noise by outputting a signal at a time before an impact noise interval MTR in an inverse phase from a loudspeaker. In the present embodiment, the filter characteristic of the control filter 21 is an inverse characteristic invC of a secondary path characteristic C. The control filter 21 converts the delay signal r in accordance with the inverse characteristic invC to generate a control signal u. The inverse characteristic invC is generally designed such that a delay time delay2 [sec] is set to be equal to or more than the delay characteristic of a secondary path through which the control signal u reaches the error microphone 10, and a transmission characteristic D2 of the delay time delay2 is substantially equal to C·invC. In this case, the time delay characteristic D is set to (MTR−delay2). The present embodiment is not provided with a filter updating unit.

The present embodiment can reduce repetitive impact noise with a simple arrangement. If, however, a sampling frequency is low, it is generally not possible to reduce noise in a high-frequency band. In addition, depending on a sampling frequency, an MTR cannot be accurately expressed. This may cause a phase shift. The noise reduction system according to this embodiment will be referred to as AL1 (Algorithm 1).

Second Embodiment

The second embodiment will exemplify an adaptive FB (feedback) NLMS system with a delay.

Figure 5:
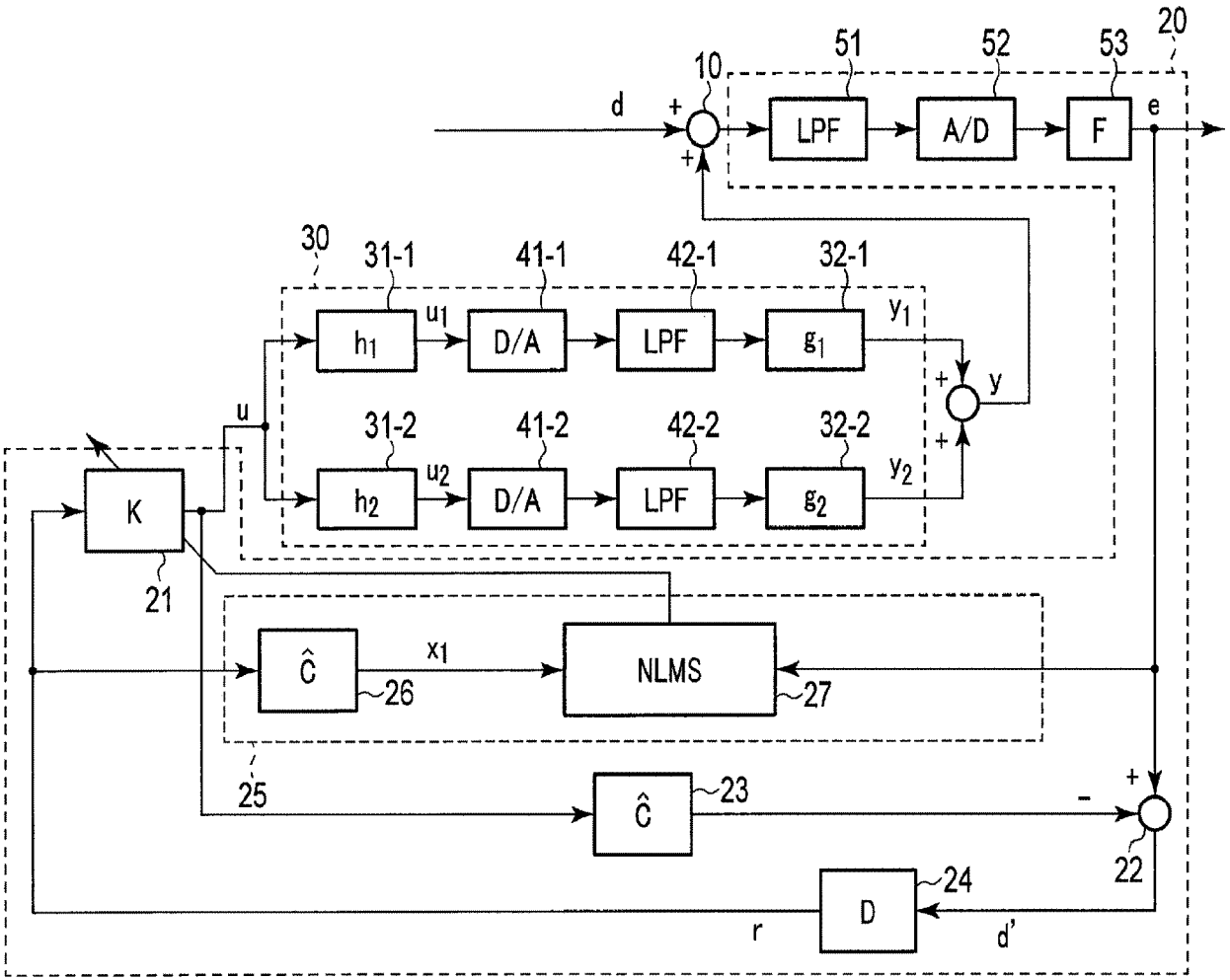
FIG. 5 is a block diagram showing a noise reduction system according to the second embodiment.

FIG. 5 schematically shows a noise reduction system according to the second embodiment. The noise reduction system shown in FIG. 5 includes an error microphone 10, a control signal generator 20, and a loudspeaker unit 30. A description of the same portions as those in the first embodiment, such as the loudspeaker unit 30, will be omitted.

The control signal generator 20 includes a control filter 21, a subtractor 22, a secondary path filter 23, delay filter 24, and a filter updating unit 25. In the present embodiment, the filter updating unit 25 adaptively updates a control characteristic K of the control filter 21. The filter updating unit 25 includes an auxiliary filter 26 and an updating unit 27. The auxiliary filter 26 has an estimated secondary path characteristic $\hat{C}$, and converts a delay signal r in accordance with the estimated secondary path characteristic $\hat{C}$ to generate an auxiliary signal $x_1$. The updating unit 27 adaptively updates the control characteristic K of the control filter 21 by using an error signal e and the auxiliary signal $x_1$ in accordance with an NLMS algorithm.

A time delay characteristic D is set to about (MTR−delay2). In the present embodiment, since a phase shift due to a sampling frequency or the like can be adjusted by adaptively changing the control filter 21, noise in a high-frequency band can be reduced. The initial state of the control filter 21 can be set to 0 vector or an inverse characteristic invC of a secondary path characteristic C. A noise reduction system according to the embodiment with the initial state of the control filter 21 being set to 0 vector will be referred to as AL2 (Algorithm 2). A noise reduction system according to the embodiment with the initial state of the control filter 21 being set to the inverse characteristic invC will be referred to as AL2*b* (Algorithm 2*b*). When using AL2*b*, it is necessary to limit the time delay characteristic D to (MTR−delay2). However, it will shorten the time before an impact noise reduction effect appears.

Third Embodiment

The third embodiment will exemplify an adaptive FB high-speed updating system with a delay.

Figure 6:
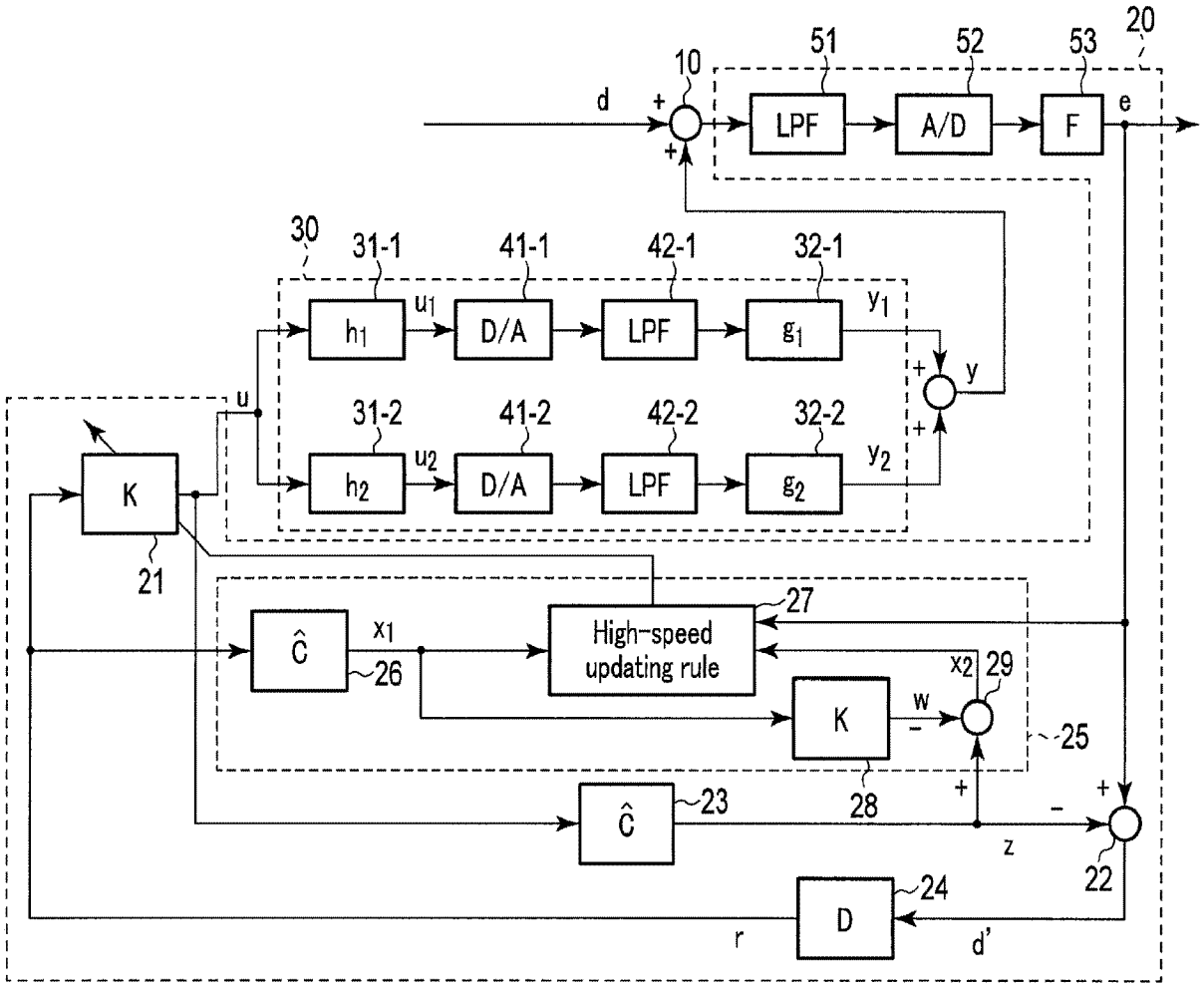
FIG. 6 is a block diagram showing a noise reduction system according to the third embodiment.

FIG. 6 schematically shows a noise reduction system according to the third embodiment. The noise reduction system shown in FIG. 6 includes an error microphone 10, a control signal generator 20, and a loudspeaker unit 30. A description of the same portions as those in the first embodiment, such as the loudspeaker unit 30, will be omitted.

The control signal generator 20 includes a control filter 21, a subtractor 22, a secondary path filter 23, a delay filter 24, and a filter updating unit 25. In the present embodiment, the filter updating unit 25 adaptively updates a control characteristic K of the control filter 21. The filter updating unit 25 includes an auxiliary filter 26, an updating unit 27, an auxiliary filter 28, and a subtractor 29. The auxiliary filter 26 has an estimated secondary path characteristic $\hat{C}$ and converts a delay signal r in accordance with the estimated secondary path characteristic $\hat{C}$ to generate an auxiliary signal $x_1$. The auxiliary filter 28 converts the auxiliary signal $x_1$ in accordance with the control characteristic K, which is identical to the current (latest) control characteristic K of the control filter 21, to generate a signal w. The subtractor 29 subtracts the signal w from an estimated control signal z to generate an auxiliary signal $x_2$. The updating unit 27 adaptively updates the control characteristic K of the control filter 21 based on an error signal e, the auxiliary signal $x_1$, and the auxiliary signal $x_2$. An updating rule according to the present embodiment is disclosed in Goto, "The proposal of New Noise Control Method for Easing a Bad Influence of Delay Characteristic", The Journal of the Acoustical Society of Japan, edited by the Acoustical Society of Japan, pp. 565-568, 2014. In summary, the control characteristic K is updated by using the steepest descent method so as to minimize an evaluation function J expressed by, for example, equation (5) given below:

$$J(n)=e(n)^2+(z(n)-w(n))^2 \tag{5}$$

where n represents the time. For example, e(n) represents an error signal at time n. Specifically, the control characteristic K is updated in accordance with equation (6) or (7) given below. Equation (6) represents an updating rule based on LMS. Equation (7) represents an updating rule based on NLMS.

$$\theta_K(n+1)=\theta_K(n)-2\mu(e(n)-(z(n)-w(n)))\psi(n) \tag{6}$$

$$\theta_K(n+1)=\theta_K(n)-\frac{2\mu}{|\psi|^2+\beta}(e(n)-(z(n)-w(n)))\psi(n) \tag{7}$$

$$\theta_K[\theta_{K(0)},\theta_{K(1)},\ldots,\theta_{K(KL-1)}]^T$$

$$\psi(n)=\left[\sum_{i=0}^{CL-1}\theta_{\hat{C}(i)}r(n-i-0),\ldots,\sum_{i=0}^{CL-1}\theta_{\hat{C}(i)}r(n-i-(KL-1))\right]^T$$

$$\theta_{\hat{C}}=[\theta_{\hat{C}(0)},\theta_{\hat{C}(1)},\ldots,\theta_{\hat{C}(CL-1)}]^T$$

where μ represents a step size in the steepest descent method, $\theta_K$ is a FIR representation of the control characteristic K, KL represents the filter length of $\theta_K$, $\theta_{\hat{C}}$ is a FIR representation of the estimated secondary path characteristic $\hat{C}$, CL represents the filter length of $\theta_{\hat{C}}$, and ψ(n) represents the time-series data of the auxiliary signal $x_1$.

In the present embodiment, the difference between the signal z and the signal w is incorporated in an evaluation function to automatically decrease the updating speed as the difference increases, thereby suppressing divergence. In addition, since the step size μ can be set to a large value, the updating speed increases.

A time delay characteristic D is set to about (MTR−delay2). In the present embodiment, since a phase shift due to a sampling frequency or the like can be adjusted by adaptively changing the control filter 21, noise in a high-frequency band can be reduced. The initial state of the control filter 21 can be set to, for example, 0 vector or an inverse characteristic invC of a secondary path characteristic C. A noise reduction system according to the embodiment with the initial state of the control filter 21 being set to 0 vector will be referred to as AL3 (Algorithm 3). A noise reduction system according to the embodiment with the initial state of the control filter 21 being set to the inverse characteristic invC will be referred to as AL3*b* (Algorithm 3*b*). When using AL3*b*, it is necessary to limit the time delay characteristic D to (MTR−delay2). However, it will shorten the time before an impact noise reduction effect appears.

Fourth Embodiment

The fourth embodiment will exemplify an inverse filter adaptive FB NLMS system with a delay.

The fourth embodiment corresponds to a combination of the first embodiment and the second embodiment. A description of the same portions as those in the first and second embodiments will be omitted.

Figure 7:
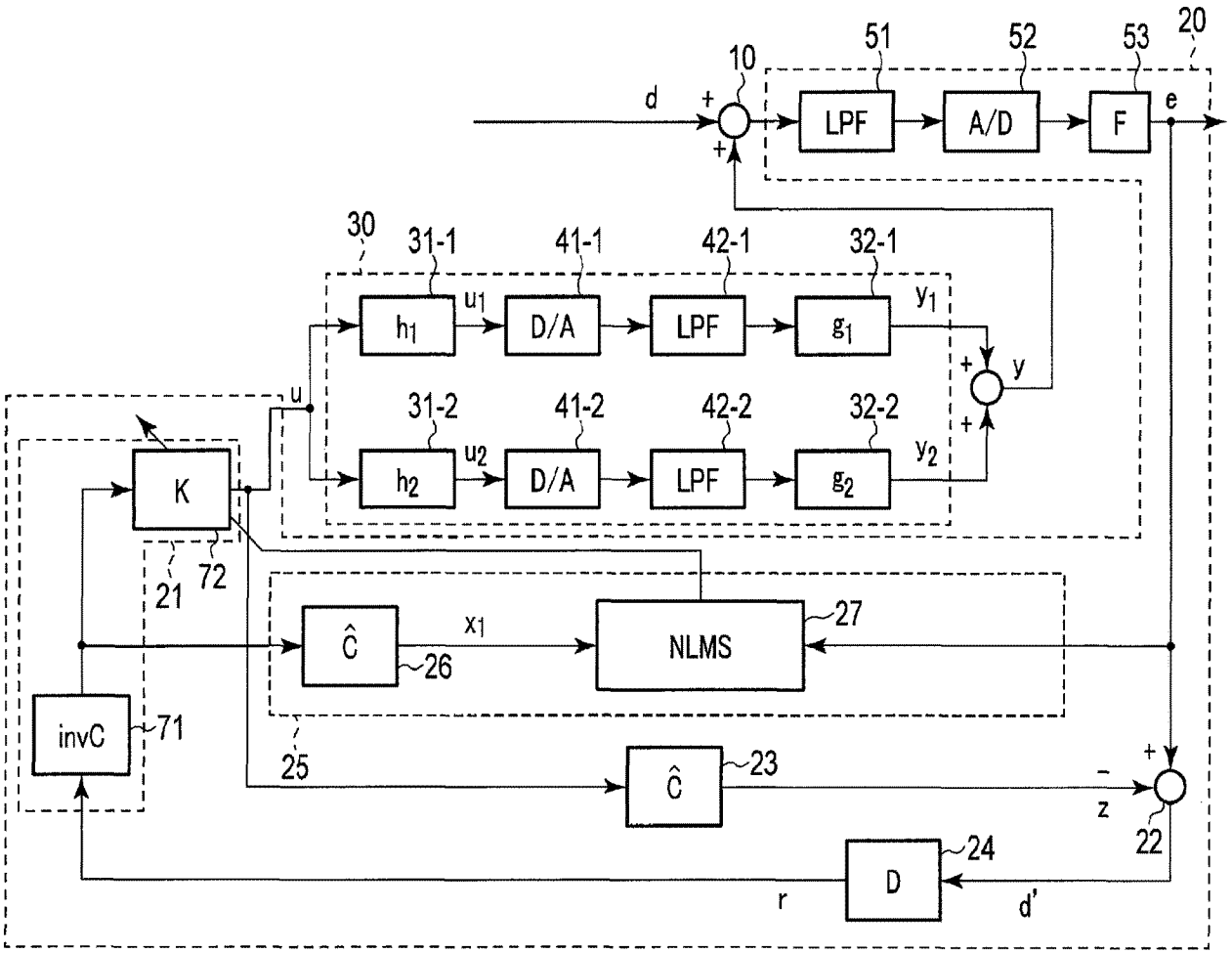
FIG. 7 is a block diagram showing a noise reduction system according to the fourth embodiment.

FIG. 7 schematically shows a noise reduction system according to the fourth embodiment. A control signal generator 20 shown in FIG. 7 includes a control filter 21, a subtractor 22, a secondary path filter 23, a delay filter 24, and a filter updating unit 25. In the present embodiment, the control filter 21 includes an inverse filter 71 which converts a delay signal r in accordance with an inverse characteristic invC of a secondary path characteristic C, and an adaptive filter 72 which converts an output signal from the inverse filter 71 in accordance with a control characteristic K to generate a control signal u. The filter updating unit 25 adaptively updates the control characteristic K. The filter updating unit 25 includes an auxiliary filter 26 and an updating unit 27. The auxiliary filter 26 has an estimated secondary path characteristic $\hat{C}$, and converts an output signal from the inverse filter 71 in accordance with the estimated secondary path characteristic $\hat{C}$ to generate an auxiliary signal $x_1$. The updating unit 27 adaptively updates the control characteristic K of the control filter 21 by using an error signal e and the auxiliary signal $x_1$ in accordance with an NLMS algorithm.

The inverse filter type system is not suitable for the reduction of high-frequency periodic noise but is suitable for the reduction of impact noise having relatively low frequencies. For this reason, it is possible to reduce impact noise components from an early stage of control. A phase shift due to a sampling frequency or the like is adjusted by adaptive filter updating. In the present embodiment, the initial state of the control characteristic K is set to [0, . . . , 0, 1, 0, . . . , 0] so as to set 1 at delay3/fs tap, where fs represents the control frequency of the system. This makes it possible to provide an effect similar to that provided by AL1 from an early stage. A delay time delay2 equal to or more than the secondary path delay characteristic is set, and invC is designed to satisfy D2=C·invC. In this case, the time delay characteristic D is set to (MTR−delay2−delay3).

According to the present embodiment, it is possible to shorten the time before an impact noise reduction effect appears. The noise reduction system according to the present embodiment will be referred to as AL4 (Algorithm 4).

Fifth Embodiment

The fifth embodiment will exemplify an inverse filter adaptive FB high-speed updating system with a delay.

The fifth embodiment corresponds to a combination of the first embodiment and the third embodiment. A description of the same portions as those in the first and third embodiments will be omitted.

Figure 8:
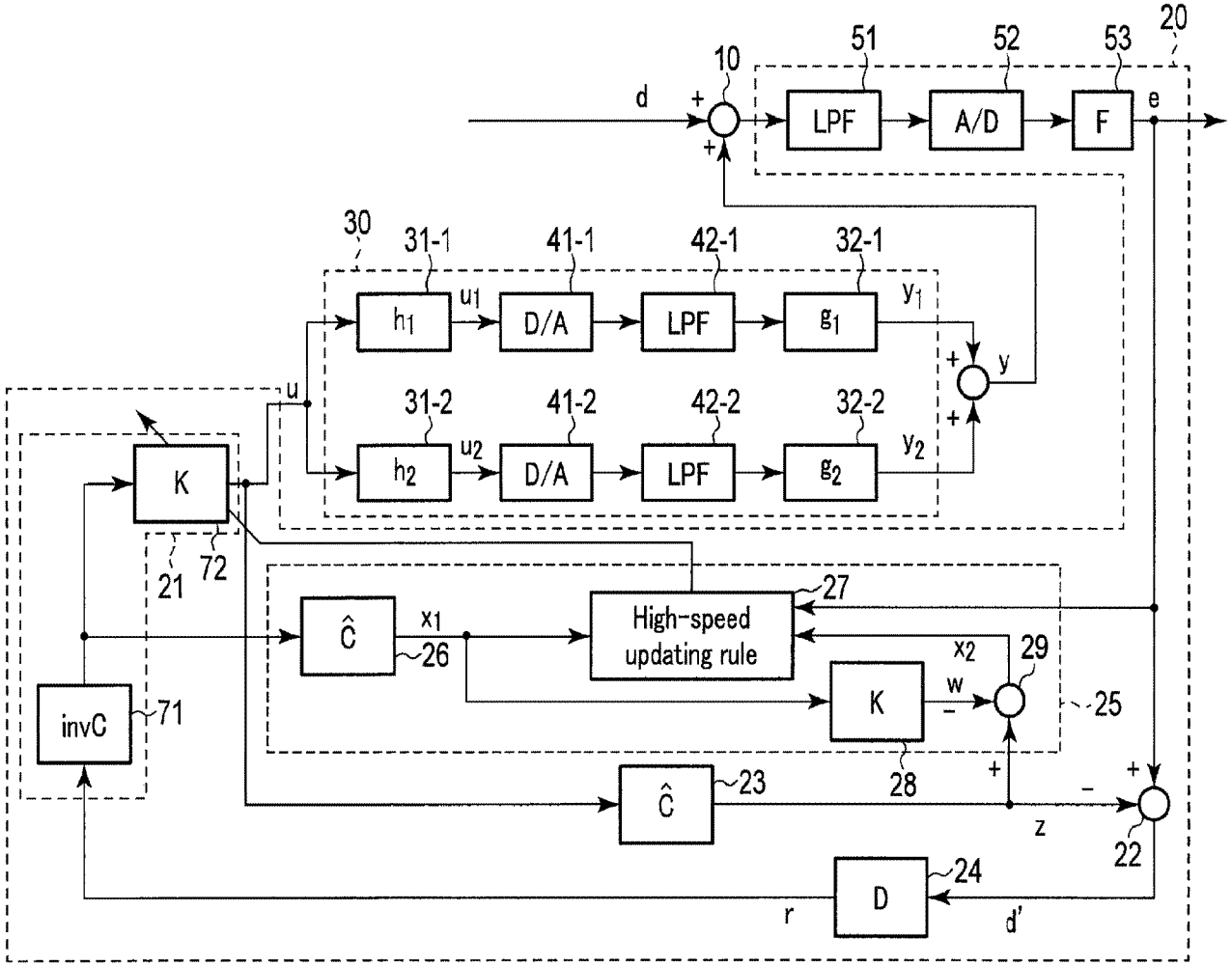
FIG. 8 is a block diagram showing a noise reduction system according to the fifth embodiment.

FIG. 8 schematically shows a noise reduction system according to the fifth embodiment. A noise reduction system shown in FIG. 8 includes a control filter 21, a subtractor 22, a secondary path filter 23, a delay filter 24, and a filter updating unit 25. In the present embodiment, the control filter 21 includes an inverse filter 71 which converts a delay signal r in accordance with an inverse characteristic invC of a secondary path characteristic C, and an adaptive filter 72 which converts an output signal from the inverse filter 71 based on a control characteristic K to generate a control signal u. The filter updating unit 25 adaptively updates the control characteristic K.

The filter updating unit 25 includes an auxiliary filter 26, an updating unit 27, an auxiliary filter 28, and a subtractor 29. The auxiliary filter 26 has an estimated secondary path characteristic $\hat{C}$, and converts an output signal from the inverse filter 71 in accordance with the estimated secondary path characteristic $\hat{C}$ to generate an auxiliary signal $x_1$. The auxiliary filter 28 has a filter characteristic K corresponding to the control characteristic K of the control filter 21 at the current time and converts the auxiliary signal $x_1$ in accordance with the control characteristic K to generate a signal w by. The subtractor 29 subtracts the signal w from an estimated control signal z to generate an auxiliary signal $x_2$. The updating unit 27 adaptively updates the control characteristic K of the control filter 21 based on an error signal e, the auxiliary signal $x_1$, and the auxiliary signal $x_2$ in accordance with a high-speed updating rule.

The inverse filter type system is not suitable for the reduction of high-frequency periodic noise but is suitable for the reduction of impact noise having relatively low frequencies. For this reason, it is possible to reduce impact noise components from an early stage of control. A phase shift due to a sampling frequency is adjusted by adaptive filter updating. In the present embodiment, the initial state of the control characteristic K is set to [0, . . . , 0, 1, 0, . . . , 0] so as to set 1 at delay3/fs tap, where fs represents the control frequency of the system. This makes it possible to provide an effect similar to that provided by AL1 from an early stage. A delay time delay2 equal to or more than the secondary path delay characteristic is set, and invC is designed to satisfy D2=C·invC. In this case, the time delay characteristic D is set to (MTR−delay2−delay3).

According to the present embodiment, it is possible to shorten the time before an impact noise reduction effect appears. The noise reduction system according to the present embodiment will be referred to as AL5 (Algorithm 5).

Sixth Embodiment

The sixth embodiment will simply exemplify a method of reducing first impact noise. The noise reduction systems according to the first to fifth embodiments cannot reduce the first impact noise. For this reason, a conventional feedback ANC system designed to reduce periodic noise is used in a time interval in which the first impact noise occurs. For example, the conventional feedback ANC system corresponds to a system obtained by omitting the delay filter from the noise reduction system shown in FIG. 1.

The noise reduction system according to the embodiment includes one of the noise reduction systems according to the first to fifth embodiments and the control signal generator of a conventional feedback ANC system. In the present embodiment, in a time interval in which the first impact noise occurs, a control signal generated by the control signal generator of the conventional feedback ANC system is used. Subsequently, a control signal generator 20 of one of the noise reduction systems according to the first to fifth embodiments is used. This can reduce the first impact noise. If, however, noise from an MRI device includes no short-period noise component, the noise reduction system according to the present embodiment is not used.

(Simulations)

The following are the results obtained from the simulation by the present inventors.

Both a filter 51 for an anti-aliasing measure and a filter 42 for signal interpolation are LPFs with a cutoff frequency of 4 kHz. The frequency band to be controlled is set to 100 Hz to 4 kHz, and the band of a bandpass filter 53 is set accordingly. As MR noise, two types of noise s1 and noise s2 are used. The noise s2 is noise which is more noticeable as impact noise than the noise s1.

Figure 9:
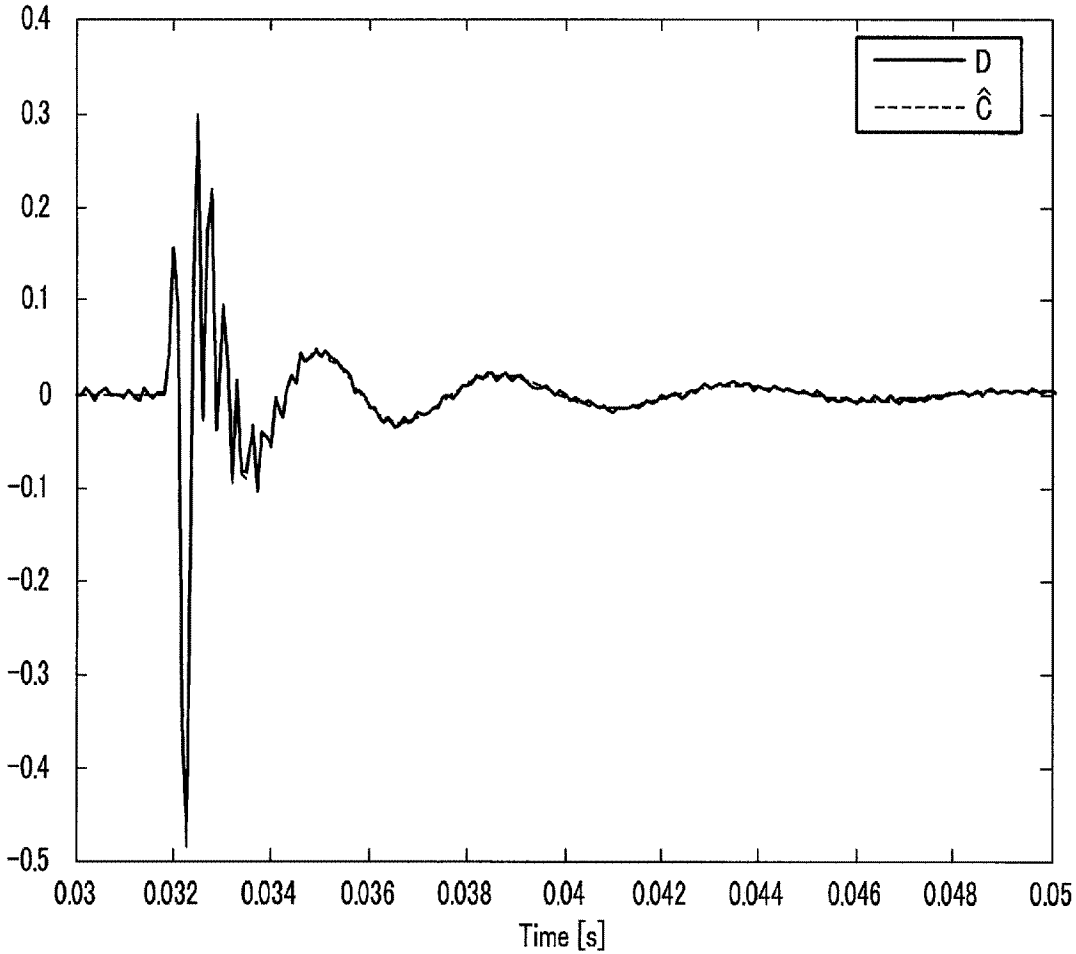
FIG. 9 is a graph showing an impulse response of an estimated secondary path characteristic.

FIG. 9 shows an impulse response of an estimated secondary path characteristic $\hat{C}$ used for the simulation. The estimated secondary path characteristic $\hat{C}$ similar to a target transmission characteristic is obtained by applying a loudspeaker unit 30.

Figure 10A:
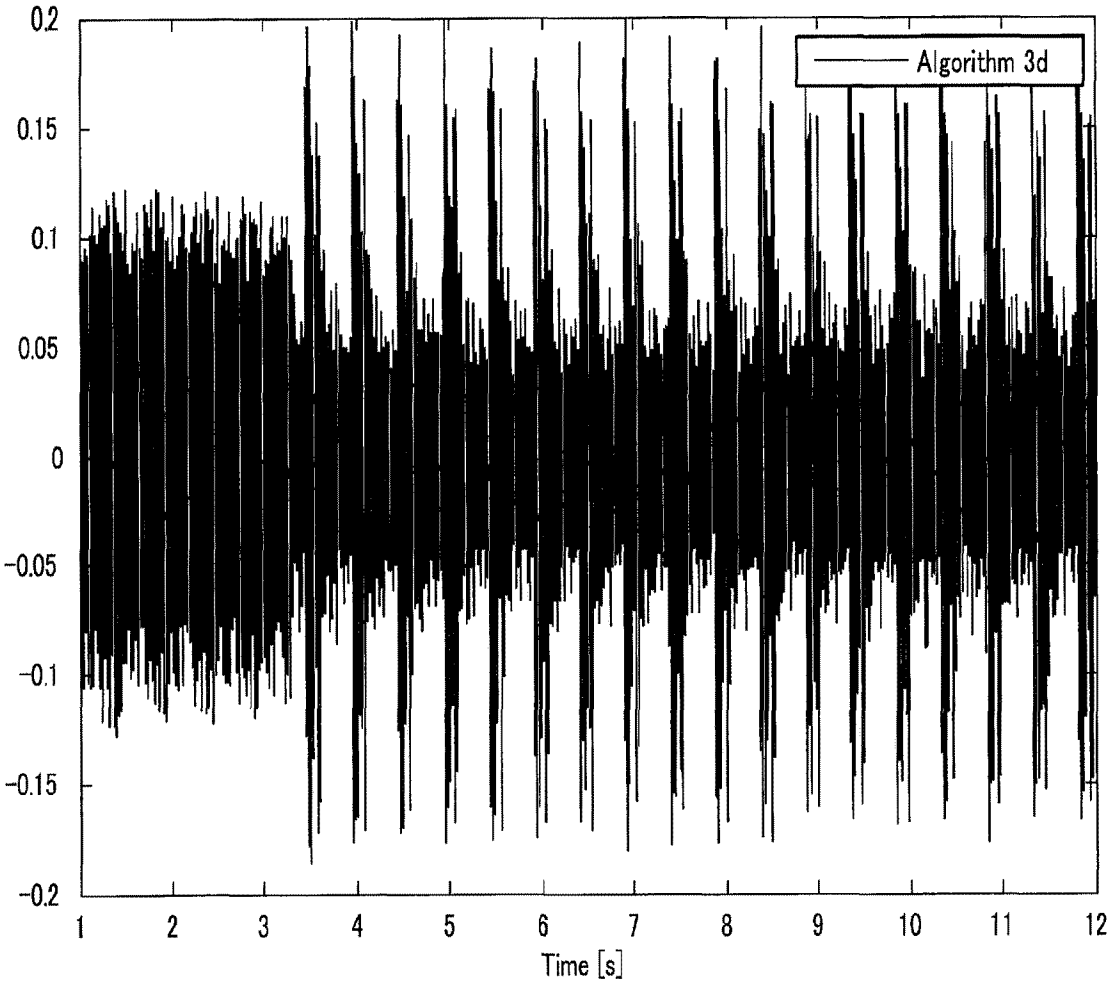
FIG. 10A is a graph showing a simulation result obtained by applying AL3*d* to noise s1.
Figure 10B:
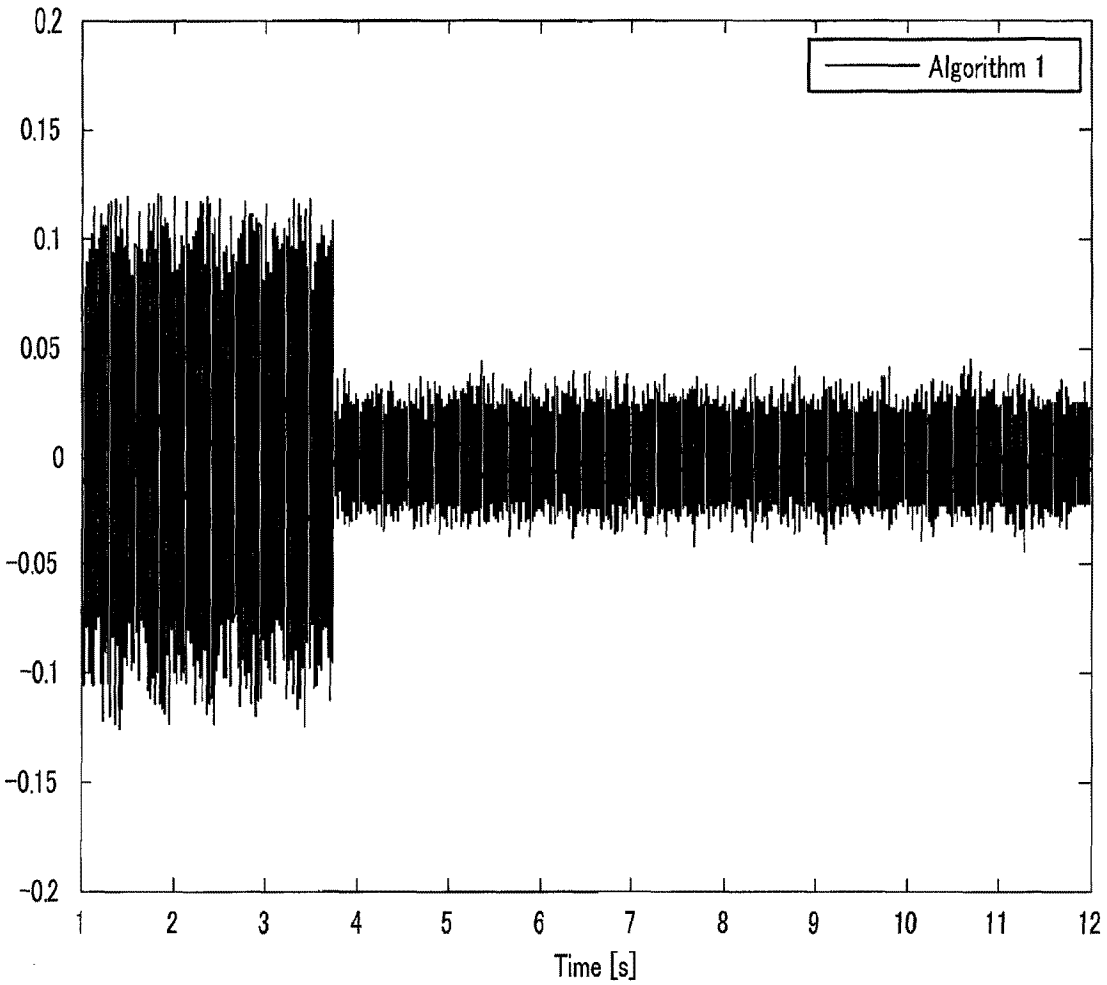
FIG. 10B is a graph showing a simulation result obtained by applying AL1 to the noise s1.
Figure 10C:
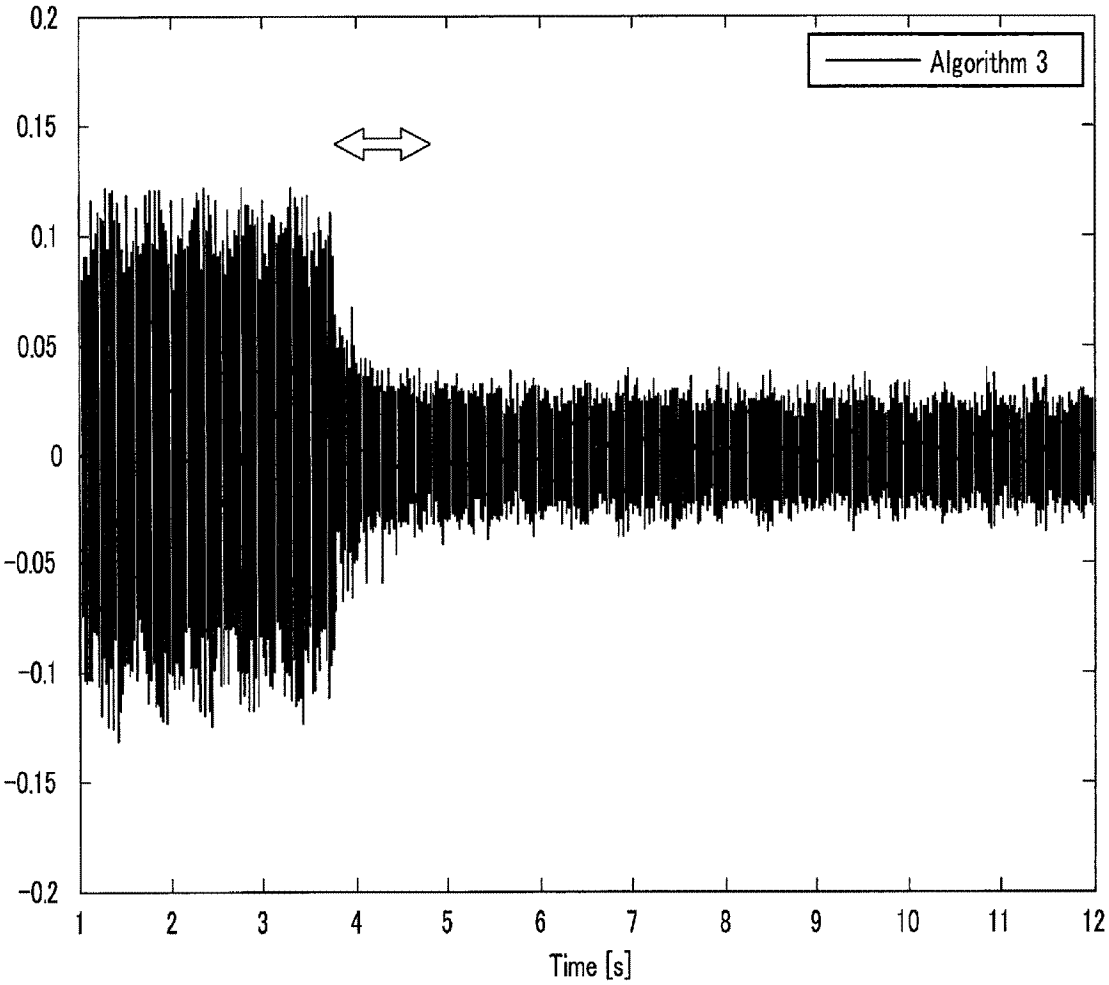
FIG. 10C is a graph showing a simulation result obtained by applying AL3 to the noise s1.
Figure 10D:
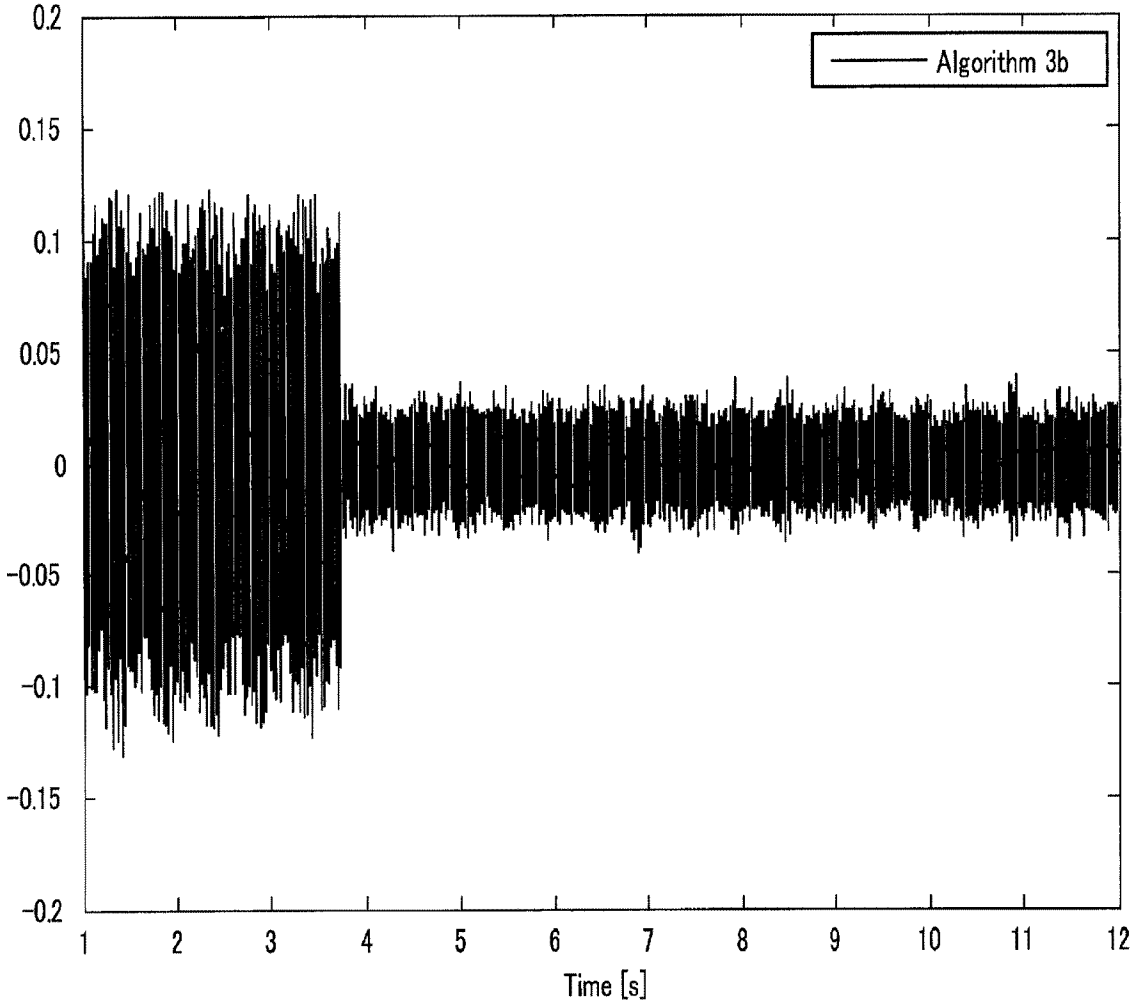
FIG. 10D is a graph showing a simulation result obtained by applying AL3*b* to the noise s1.
Figure 10E:
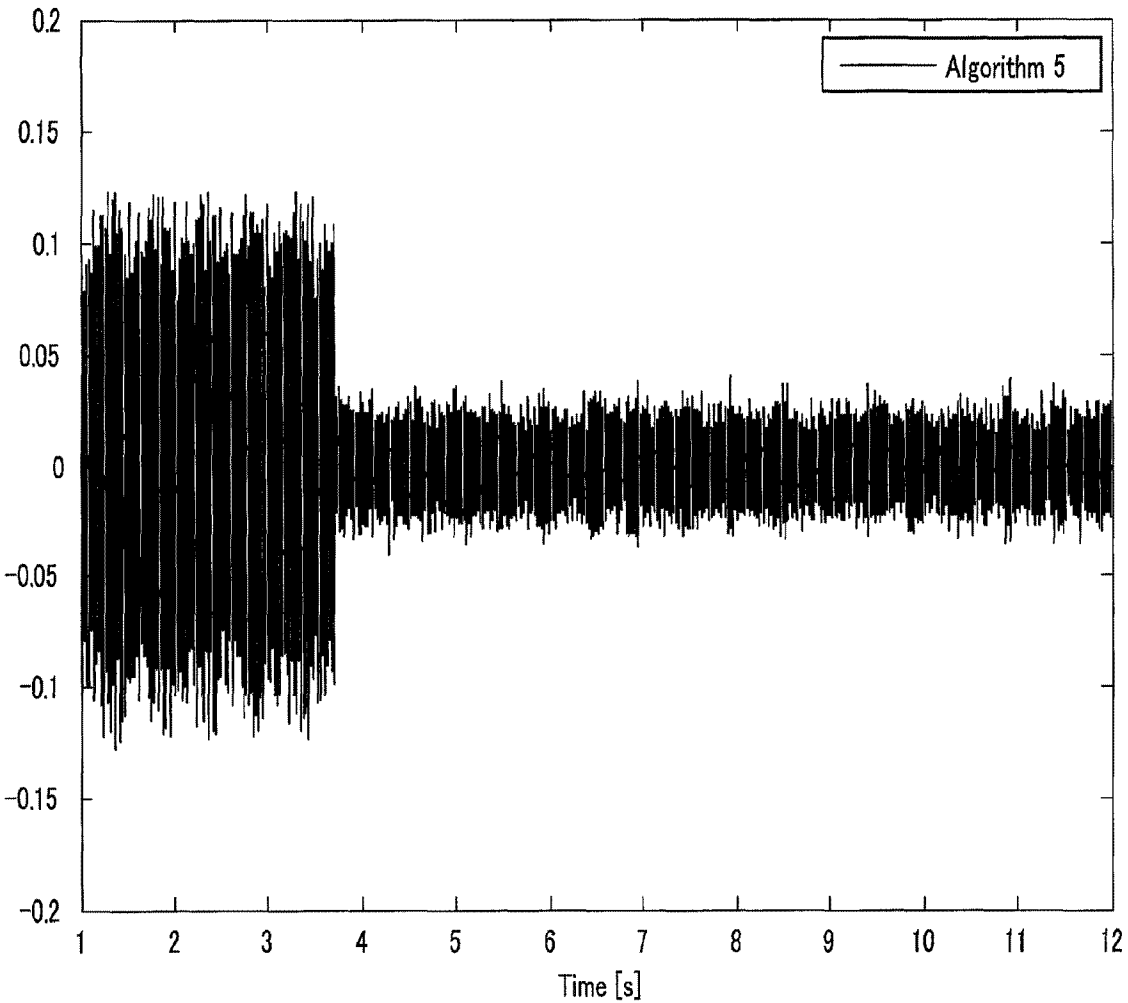
FIG. 10E is a graph showing a simulation result obtained by applying AL5 to the noise s1.

FIGS. 10A, 10B, 10C, 10D, 10E, and 10F show simulation results on the noise s1. Referring to FIGS. 10A, 10E, 10C, 10D, 10E, and 10F, control starts at about the 3 sec position. FIG. 10A shows a simulation result concerning a system AL3*d* with the time delay characteristic D being set to 1 in AL3. This system AL3*d* corresponds to the conventional feedback ANC system. As shown in FIG. 10A, if the time delay characteristic D is not properly set, the periodic noise of MR noise can be reduced, but the impact noise cannot be removed and remains. FIG. 10B shows a simulation result concerning AL1. FIG. 10E indicates that the impact noise can be reduced. FIG. 10C shows a simulation result concerning AL3. FIG. 10C indicates that the impact noise can be reduced. It, however, takes about 1.5 sec before convergence except for the initial impact period. FIG. 10D shows a simulation result concerning AL3*b*. FIGS. 10C and 10D indicate that it takes a shorter time to make a control effect appear by using AL3*b* than by using AL3. This is because the initial state of the control filter is set to an inverse filter characteristic.

Figure 10F:
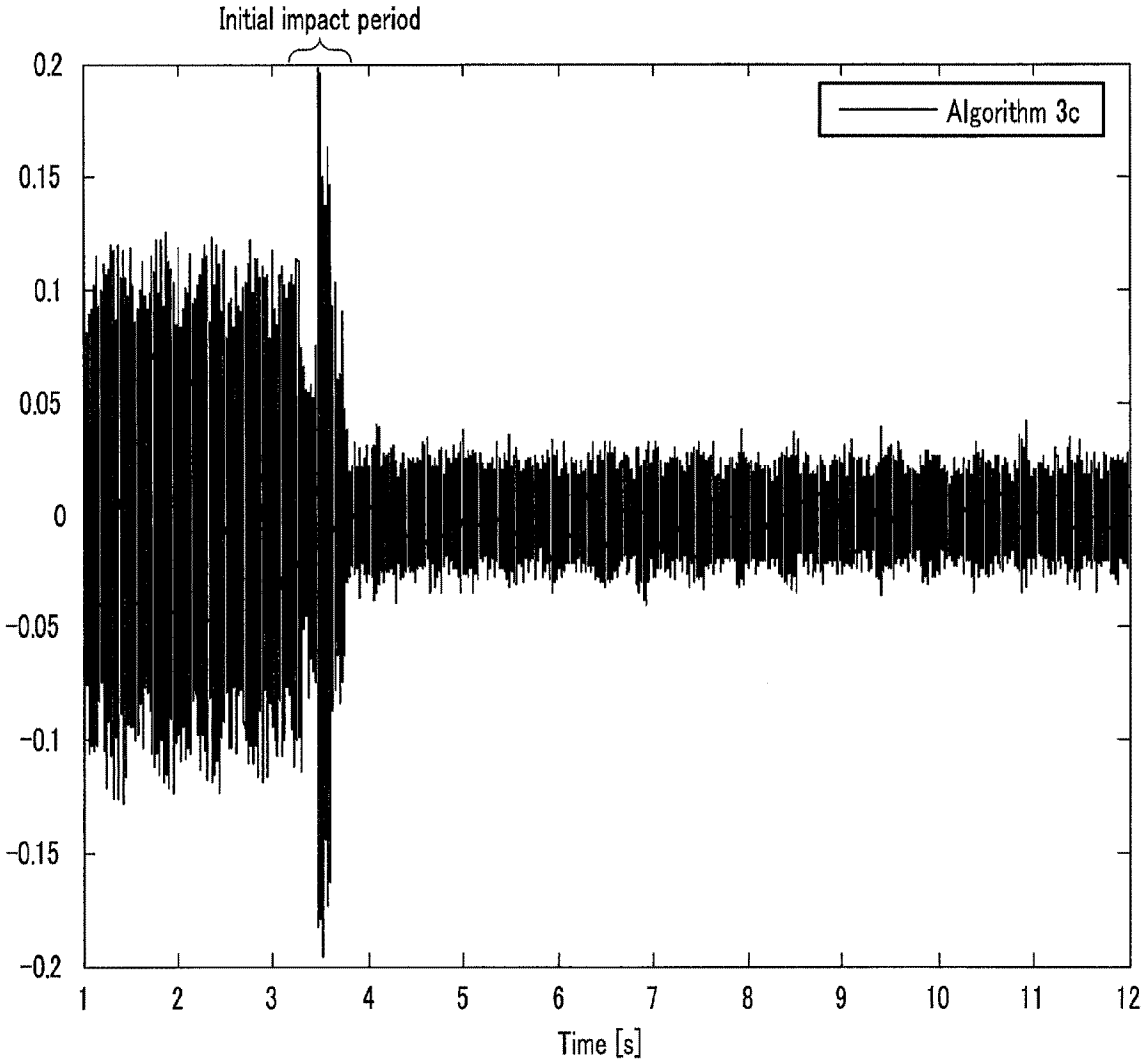
FIG. 10F is a graph showing a simulation result obtained by applying AL3*c* to the noise s1.

FIG. 10E shows a simulation result concerning AL5. FIG. 10E indicates that it does not take much time to make a control result appear by using AL5 like AL3*b*. FIG. 10F shows a simulation result concerning a system AL3*c* with conventional feedback ANC being applied to the initial impact period in AL3. FIG. 10F indicates that noise is reduced even in the initial impact period.

It is obvious from the above description that although the conventional feedback ANC system cannot reduce impact noise, the noise reduction systems according to the embodiments can reduce impact noise.

Figure 11A:
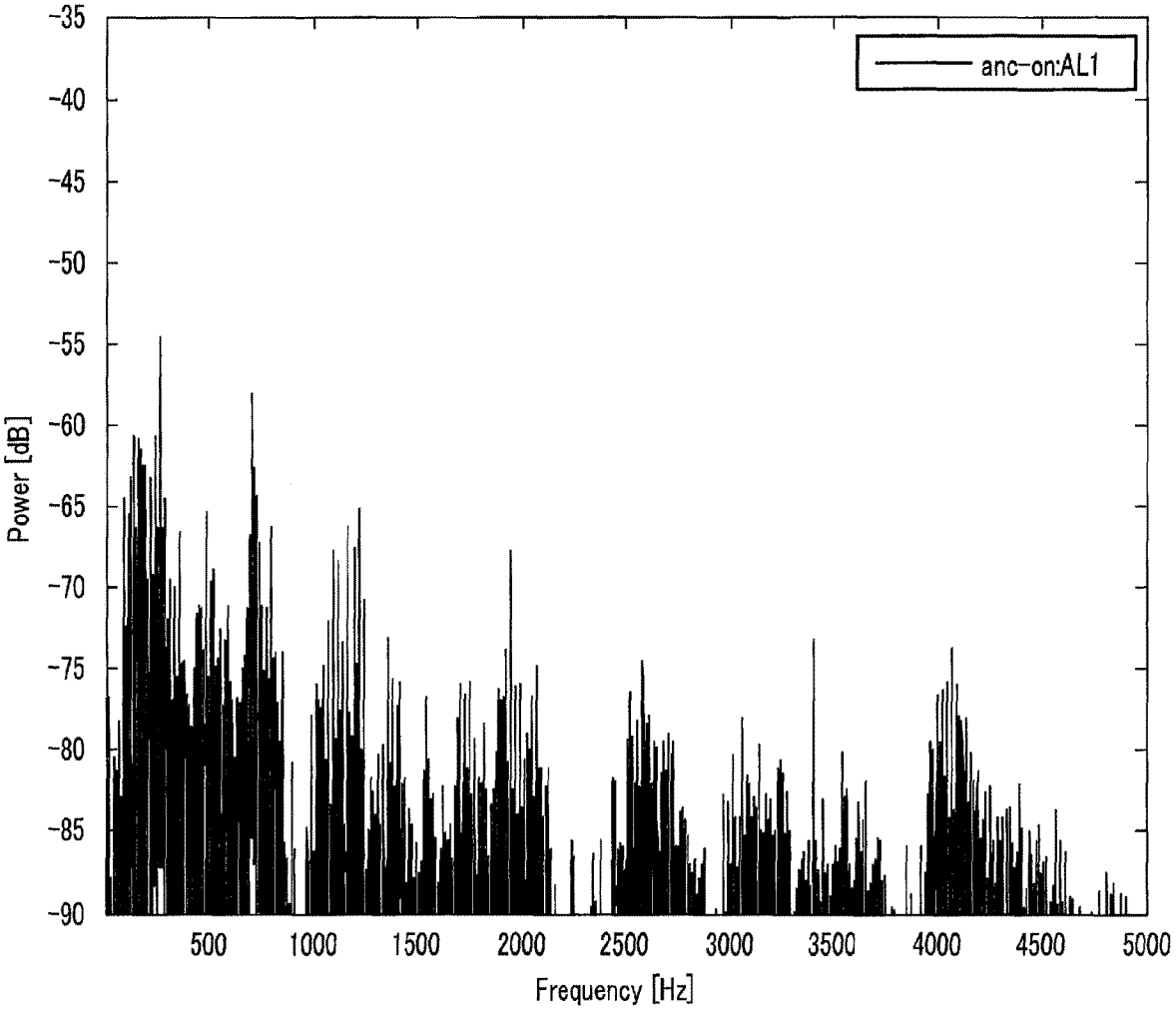
FIG. 11A is a graph showing a frequency characteristic in a period from 9 to 11 seconds in the graph shown in FIG. 10B.
Figure 11B:
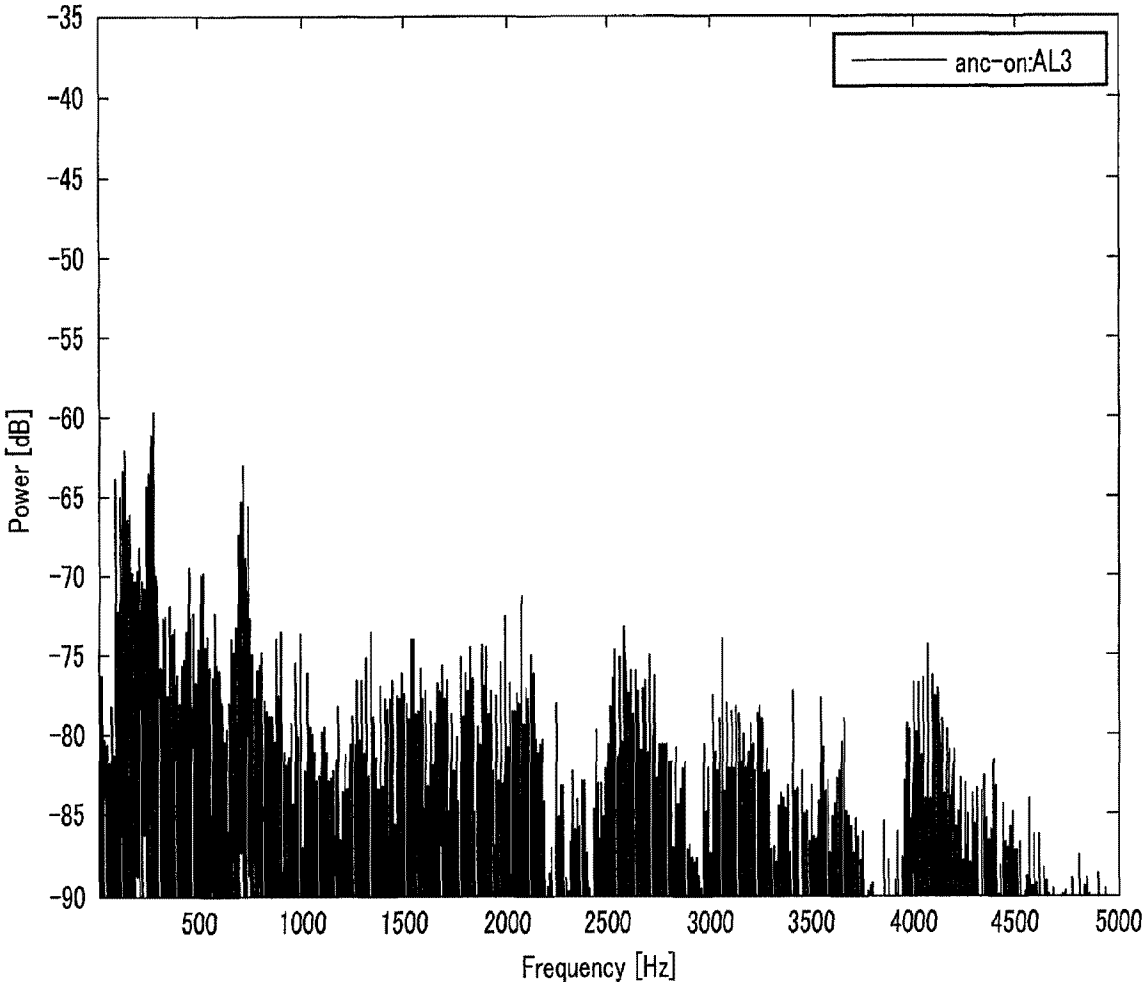
FIG. 11B is a graph showing a frequency characteristic in a period from 9 to 11 seconds in the graph shown in FIG. 10C.
Figure 11C:
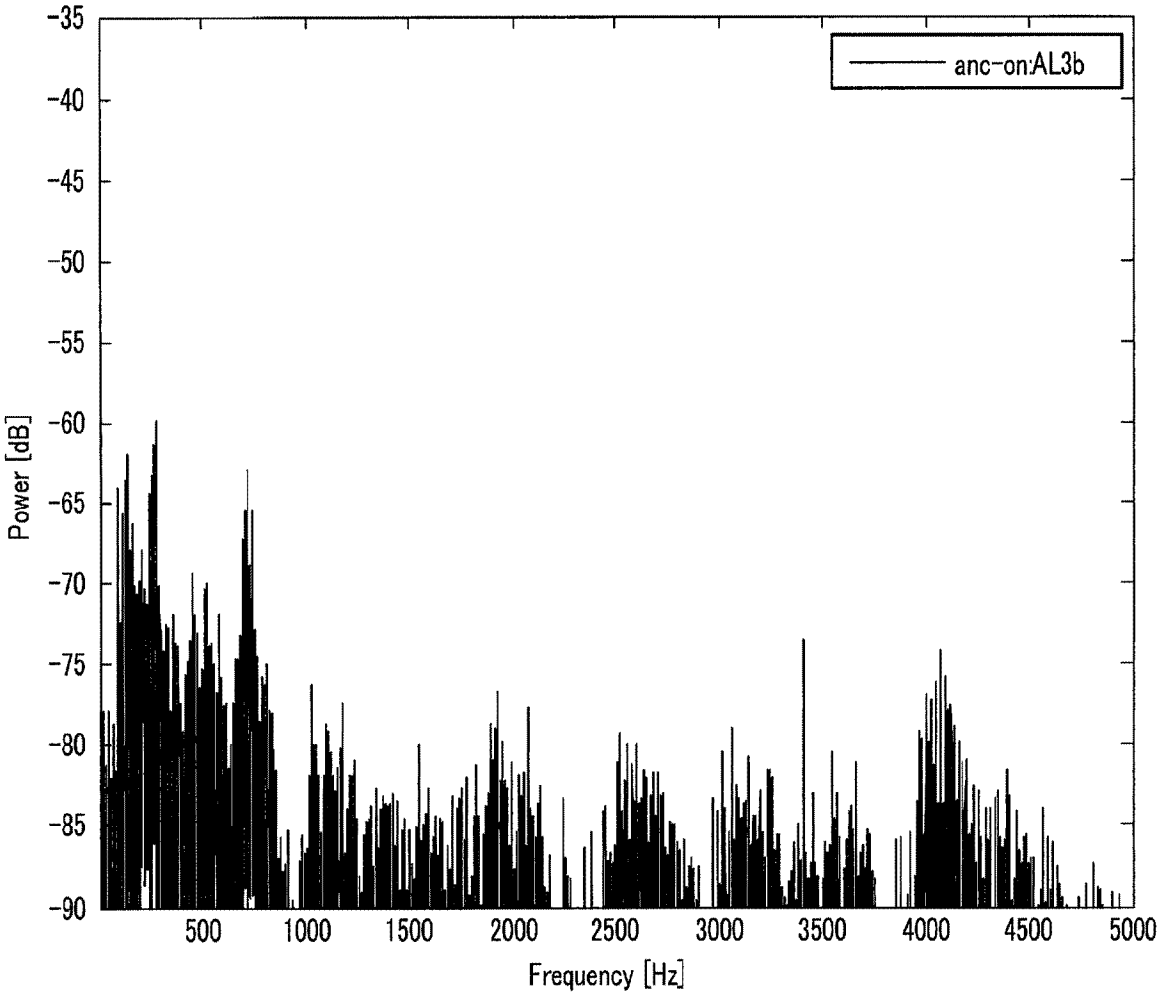
FIG. 11C is a graph showing a frequency characteristic in a period from 9 to 11 seconds in the graph shown in FIG. 10D.
Figure 11D:
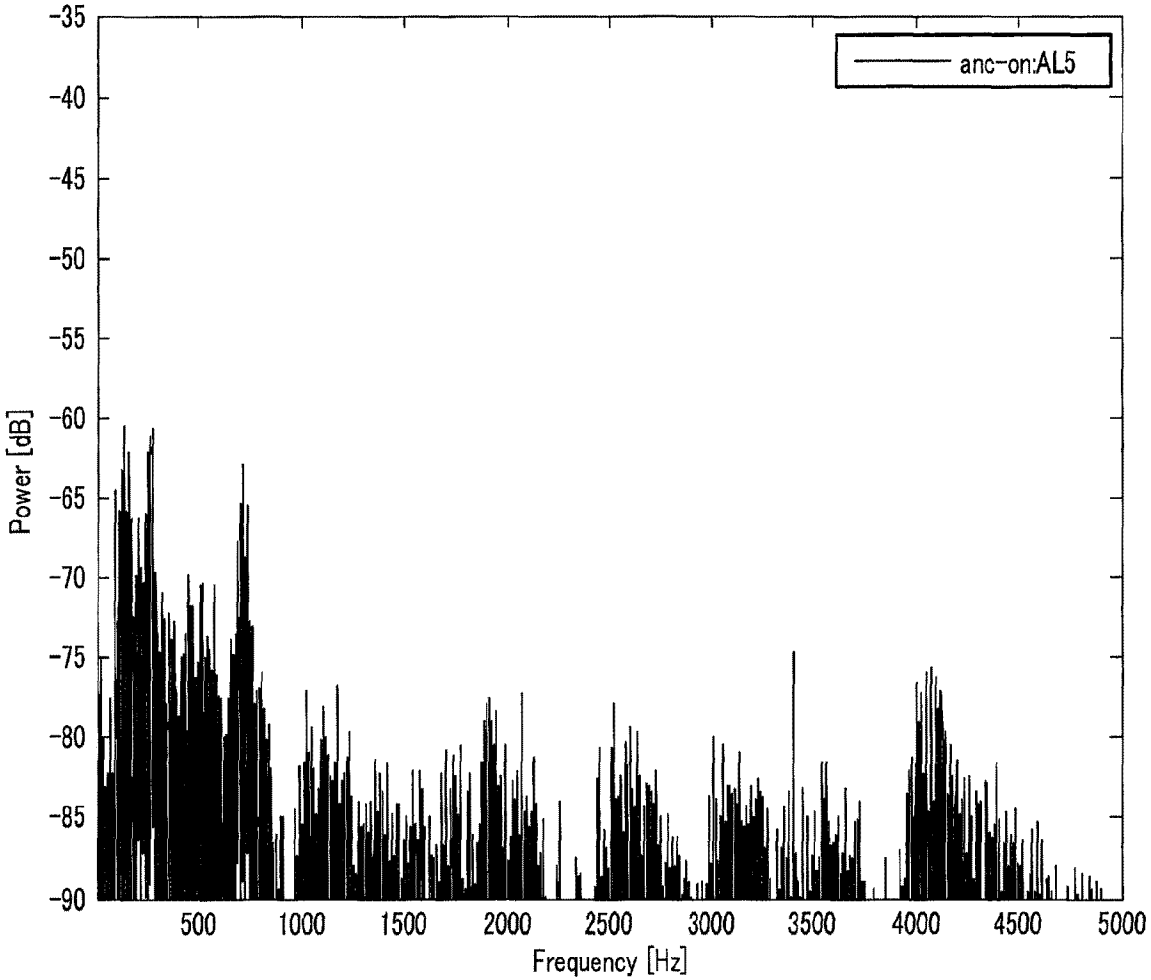
FIG. 11D is a graph showing a frequency characteristic in a period from 9 to 11 seconds in the graph shown in FIG. 10E.
Figure 11E:
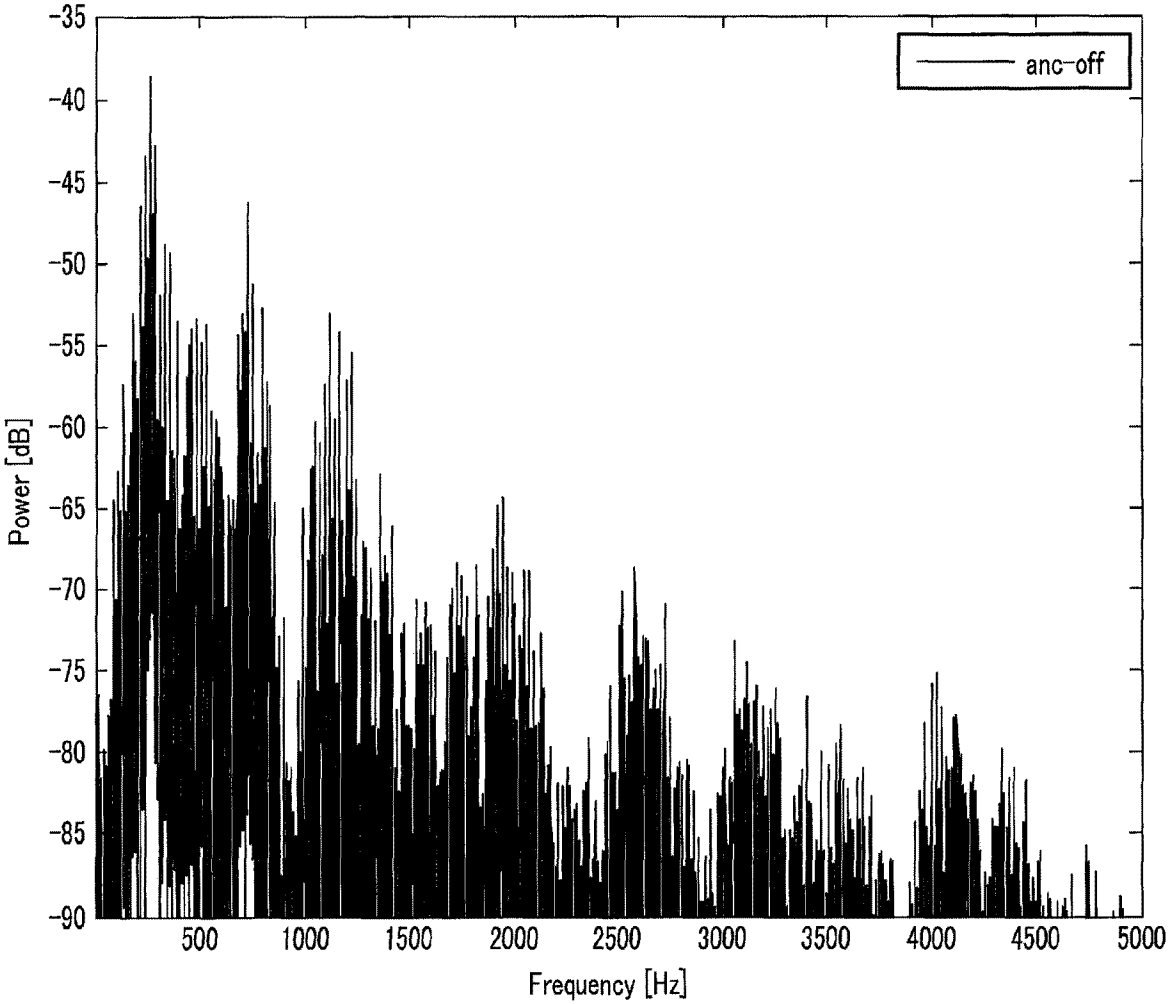
FIG. 11E is a graph showing the frequency characteristic of the noise s1 without noise reduction control.

A control effect is evaluated in terms of a frequency characteristic. FIG. 11A shows a frequency characteristic in a period from 9 to 11 seconds in FIG. 10B showing the simulation result concerning AL1. FIG. 11B shows a frequency characteristic in a period from 9 to 11 seconds in FIG. 10B showing the simulation result concerning AL3. FIG. 11C shows a frequency characteristic in a period from 9 to 11 seconds in FIG. 10C showing the simulation result concerning AL3*b*. FIG. 11D shows a frequency characteristic in a period from 9 to 11 seconds in FIG. 10E showing the simulation result concerning AL5. FIG. 11E shows a frequency characteristic without control.

FIGS. 11A and 11B indicate that although AL3 can reduce noise with high sound pressures (noise of −75 dB or more) at frequencies equal to or less than 2 kHz, AL1 exhibits a higher control effect concerning noise with low sound pressures (noise of −75 dB or less) at frequencies equal to or more than 1 kHz. This is because the control filter used by AL3 has not converged. FIGS. 11C and 11D indicate that control effects obtained by AL3*b* and AL5 are similar to each other and are higher than those obtained by AL1 and AL3.

It is obvious from the above description that when reducing MR noise s1, AL3*b* or AL5 is preferably used, which takes a short period of time before a control effect appears and has a high control effect.

Figure 12A:
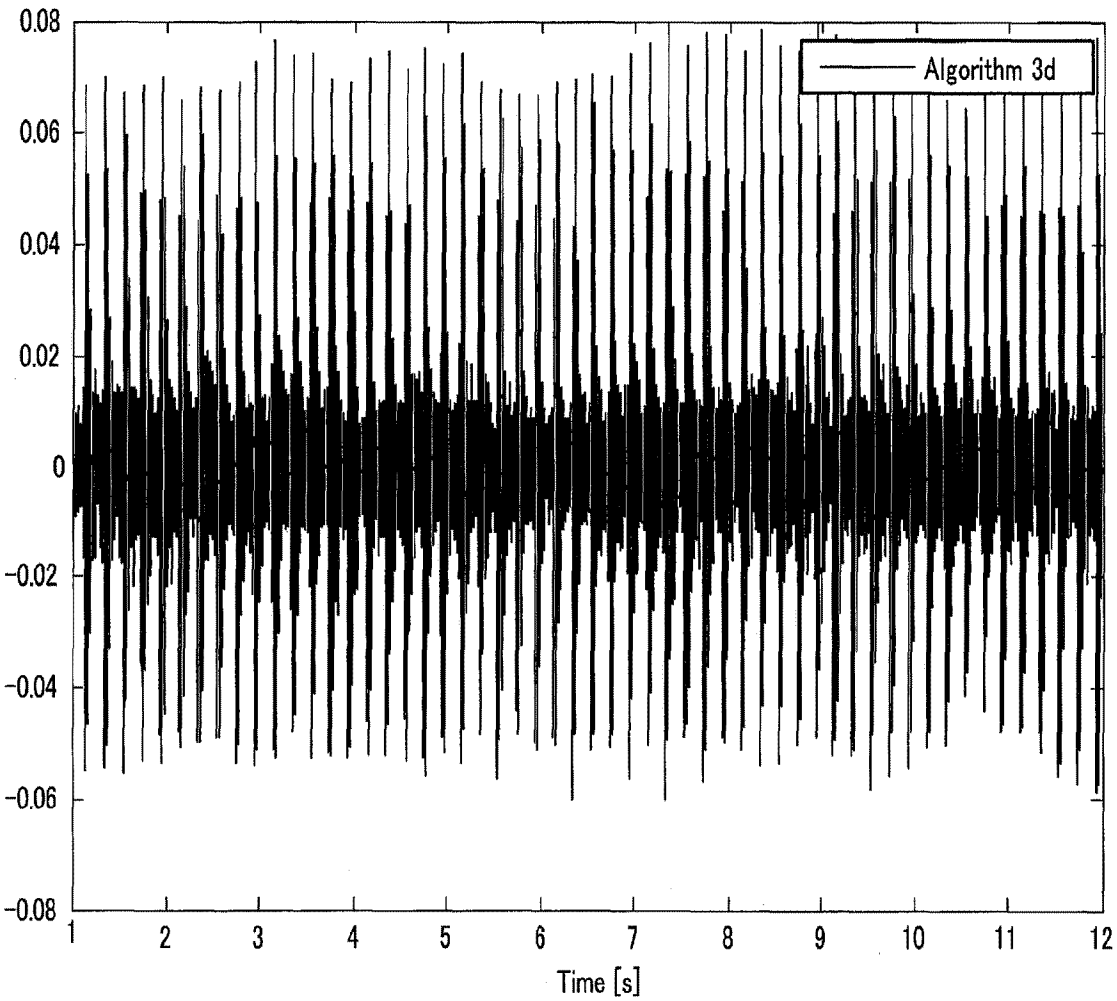
FIG. 12A is a graph showing a simulation result obtained by applying AL3*d* to noise s2.
Figure 12B:
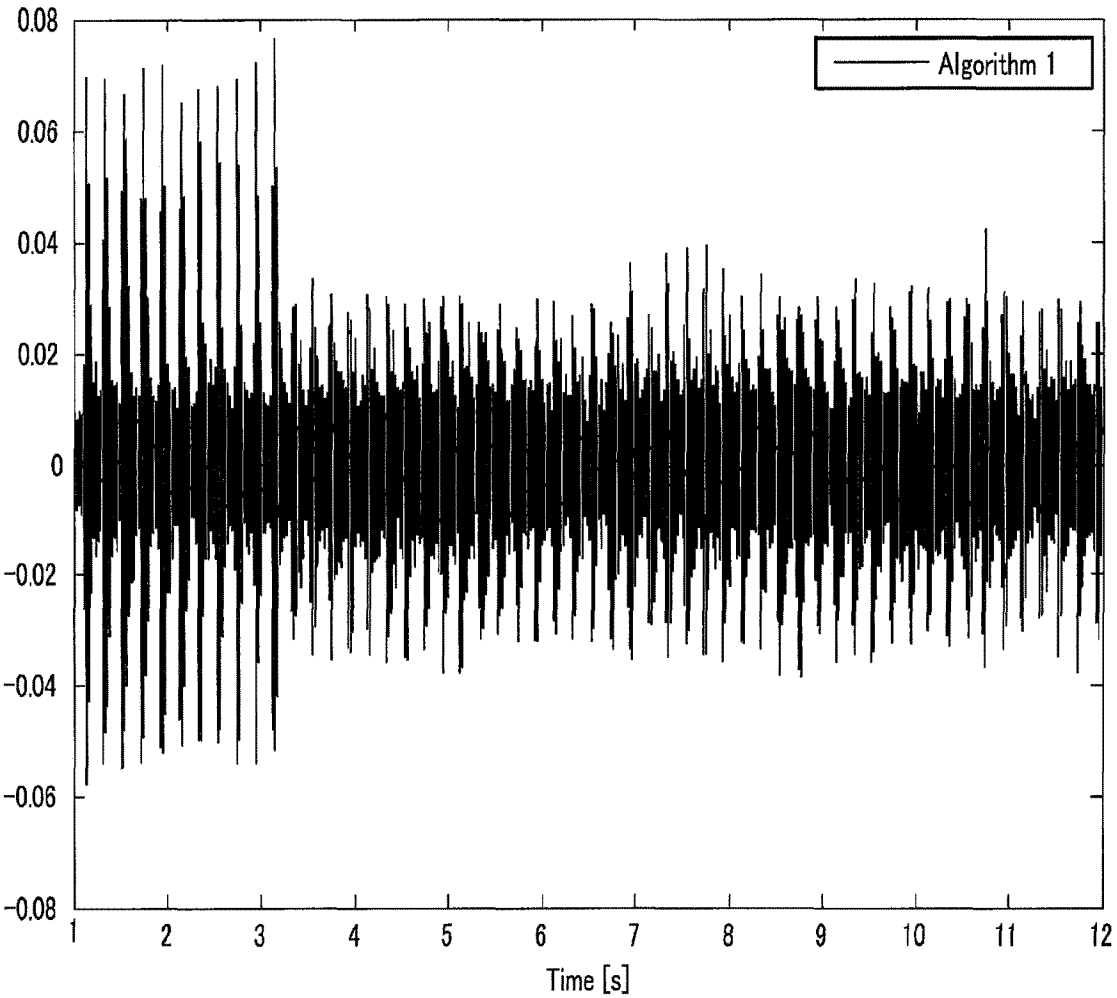
FIG. 12B is a graph showing a simulation result obtained by applying AL1 to the noise s2.
Figure 12C:
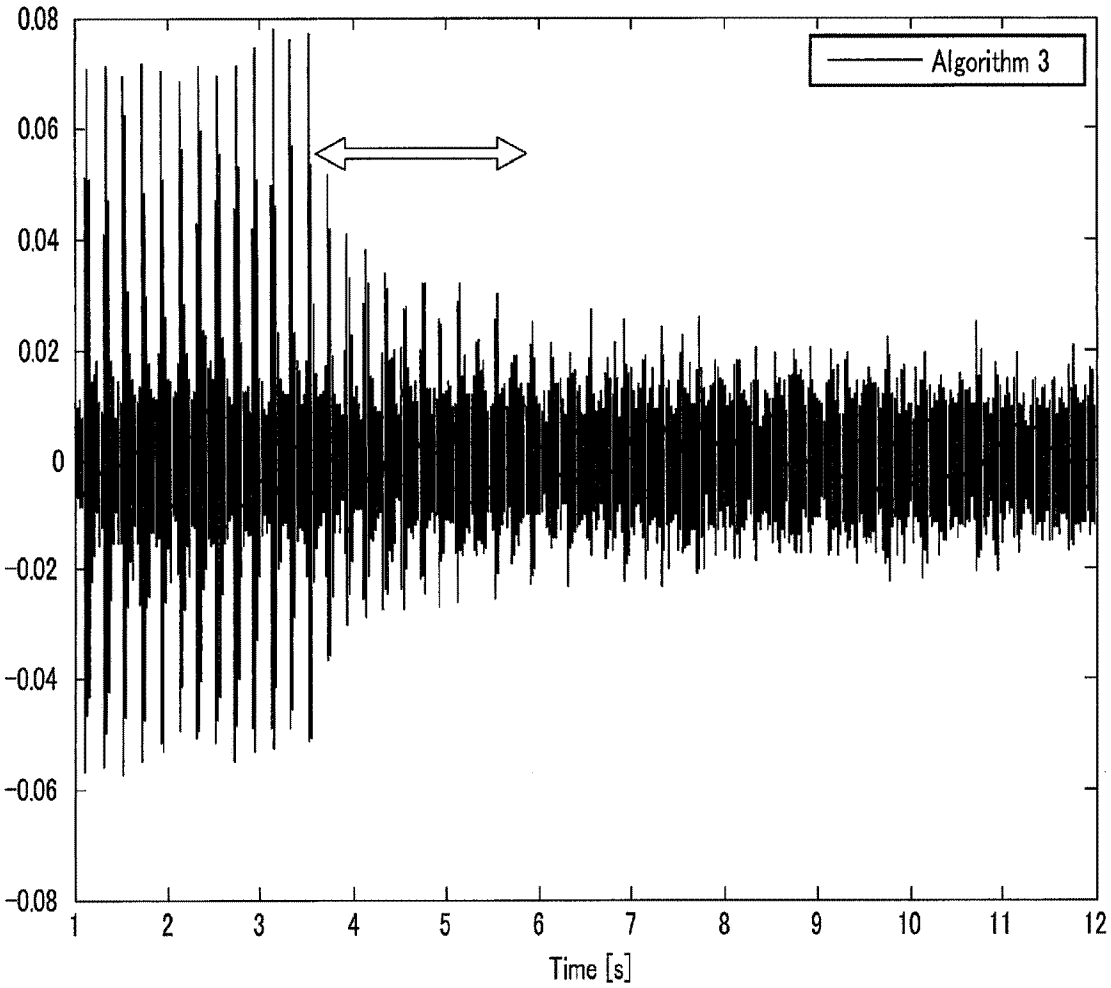
FIG. 12C is a graph showing a simulation result obtained by applying AL3 to the noise s2.
Figure 12D:
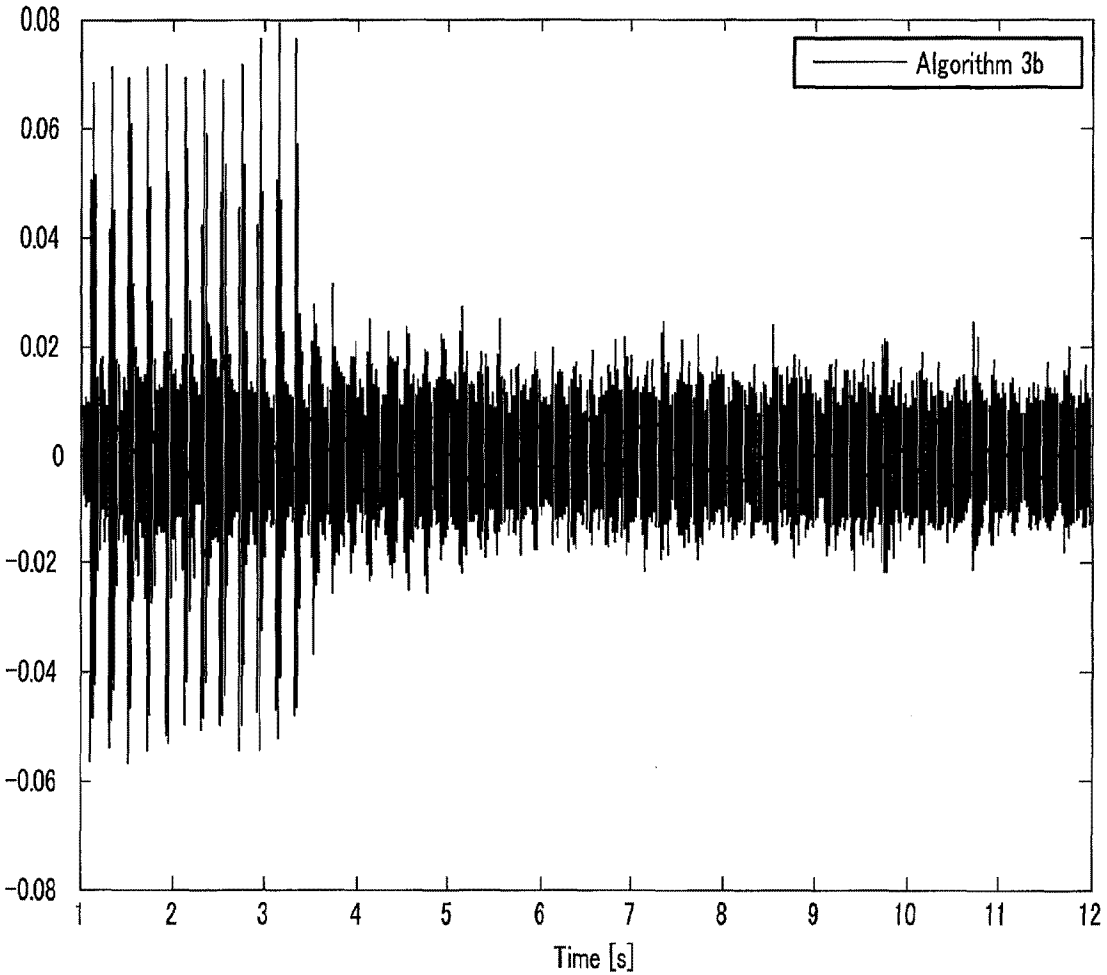
FIG. 12D is a graph showing a simulation result obtained by applying AL3*b* to the noise s2.
Figure 12E:
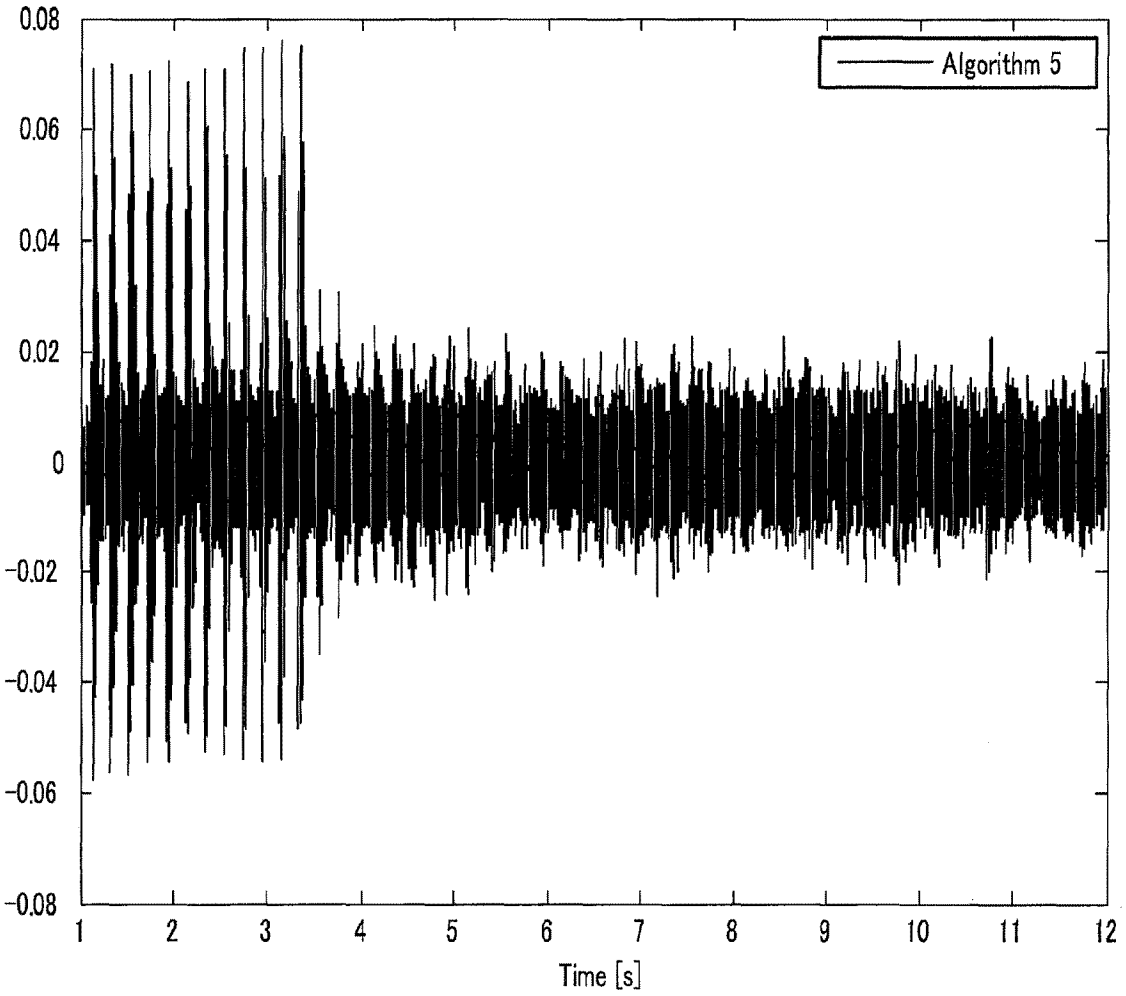
FIG. 12E is a graph showing a simulation result obtained by applying AL5 to the noise s2.

FIGS. 12A, 123, 12C, 12D, and 12E show simulation results on noise s2. Referring to FIGS. 12A, 12B, 12C, 12D, and 12E, control starts at about the 3 sec position. FIG. 12A shows a simulation result concerning the system AL3*d* with the time delay characteristic D being set to 1 in AL3. As shown in FIG. 12A, if the time delay characteristic D is not properly set, impact noise of MR noise cannot be removed and remains. FIG. 12B shows a simulation result concerning AL1. FIG. 12B indicates that the impact noise can be reduced. FIG. 12C shows a simulation result concerning AL3. FIG. 12C indicates that the impact noise can be reduced. It, however, takes about 1.5 sec before convergence except for the initial impact period. FIG. 12D shows a simulation result concerning AL3*b*. FIGS. 12C and 12D indicate that it requires a shorter time to make a control effect appear by using AL3*b* than by using AL3. This is because the initial state of the control filter is set to an inverse filter characteristic. FIG. 12E shows a simulation result concerning AL5. FIG. 10E indicates that that it does not take much time before a control result appears by using AL5 like AL3*b*.

It is obvious from the above description that although the conventional feedback ANC system cannot reduce impact noise, the noise reduction systems according to the embodiments can reduce impact noise.

Figure 13A:
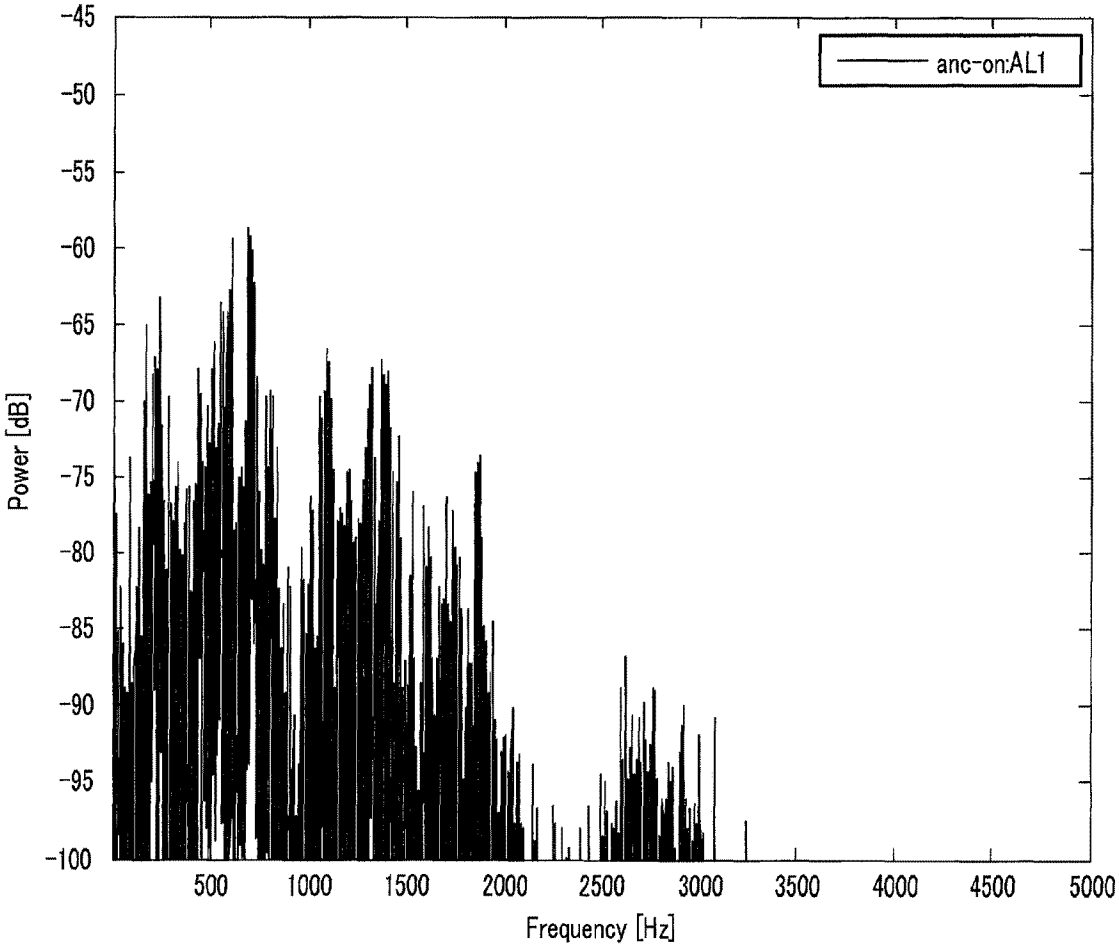
FIG. 13A is a graph showing a frequency characteristic in a period from 9 to 11 seconds in the graph shown in FIG. 12B.
Figure 13B:
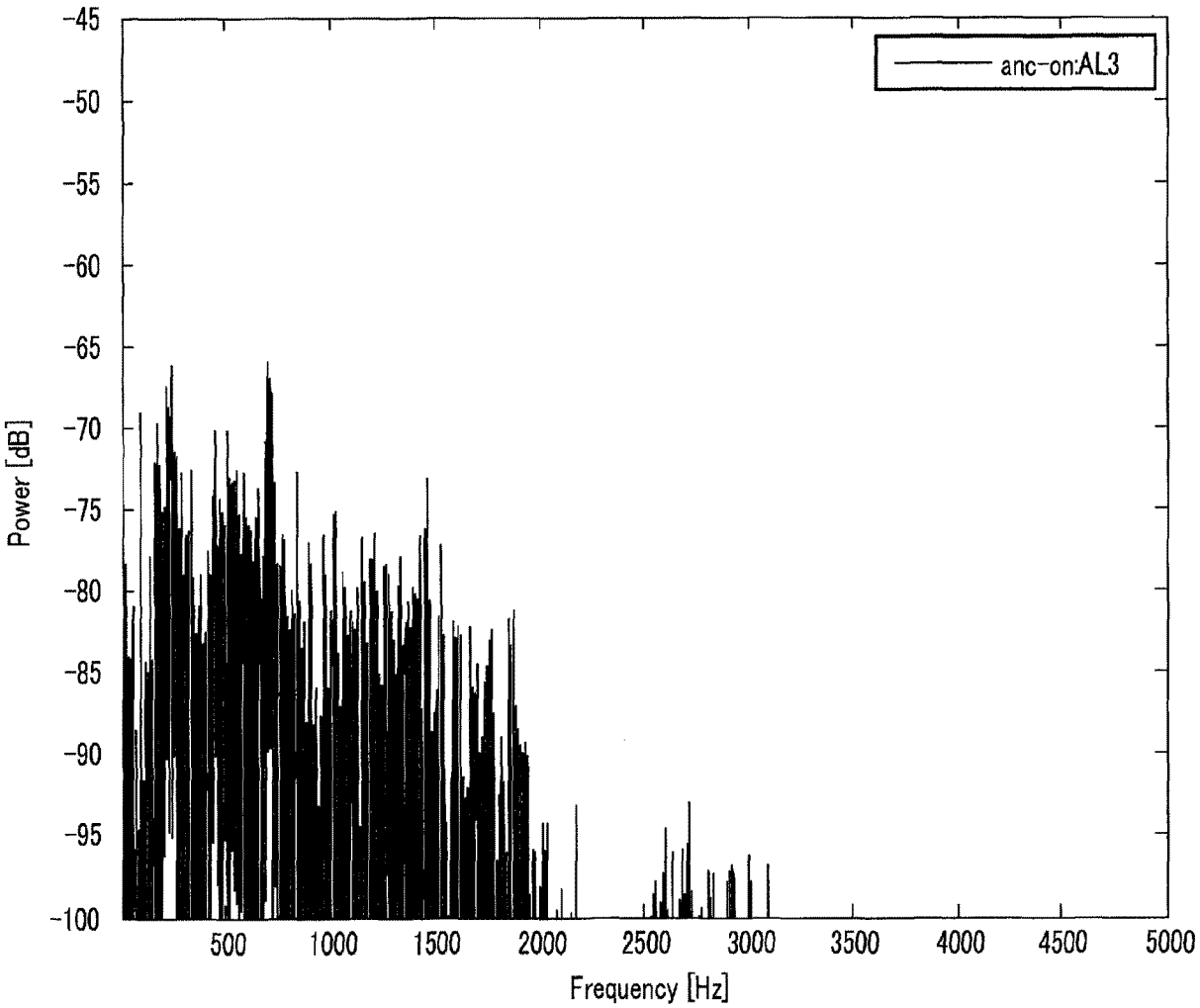
FIG. 13B is a graph showing a frequency characteristic in a period from 9 to 11 seconds in the graph shown in FIG. 12C.
Figure 13C:
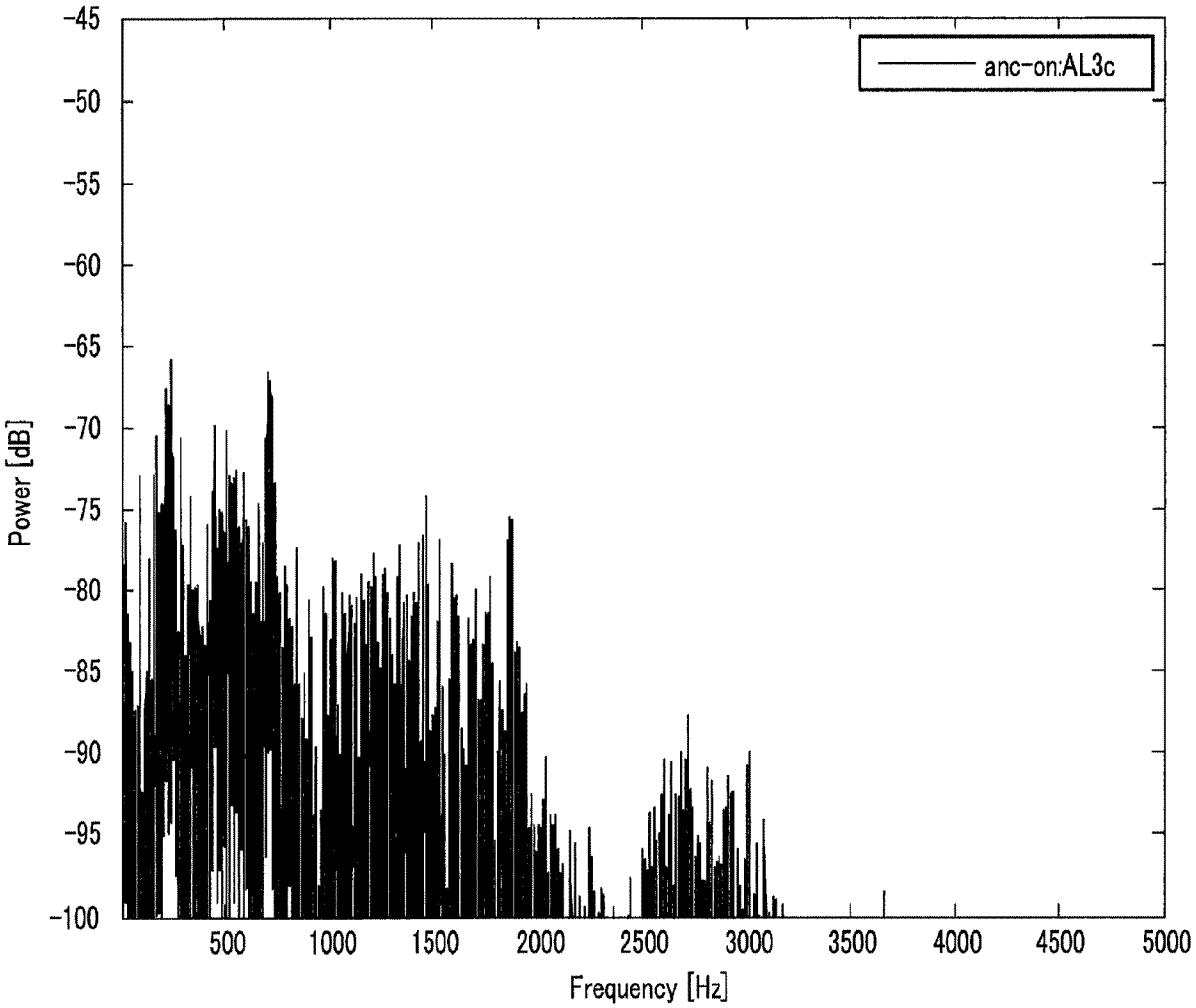
FIG. 13C is a graph showing a frequency characteristic in a period from 9 to 11 seconds in the graph shown in FIG. 12D.
Figure 13D:
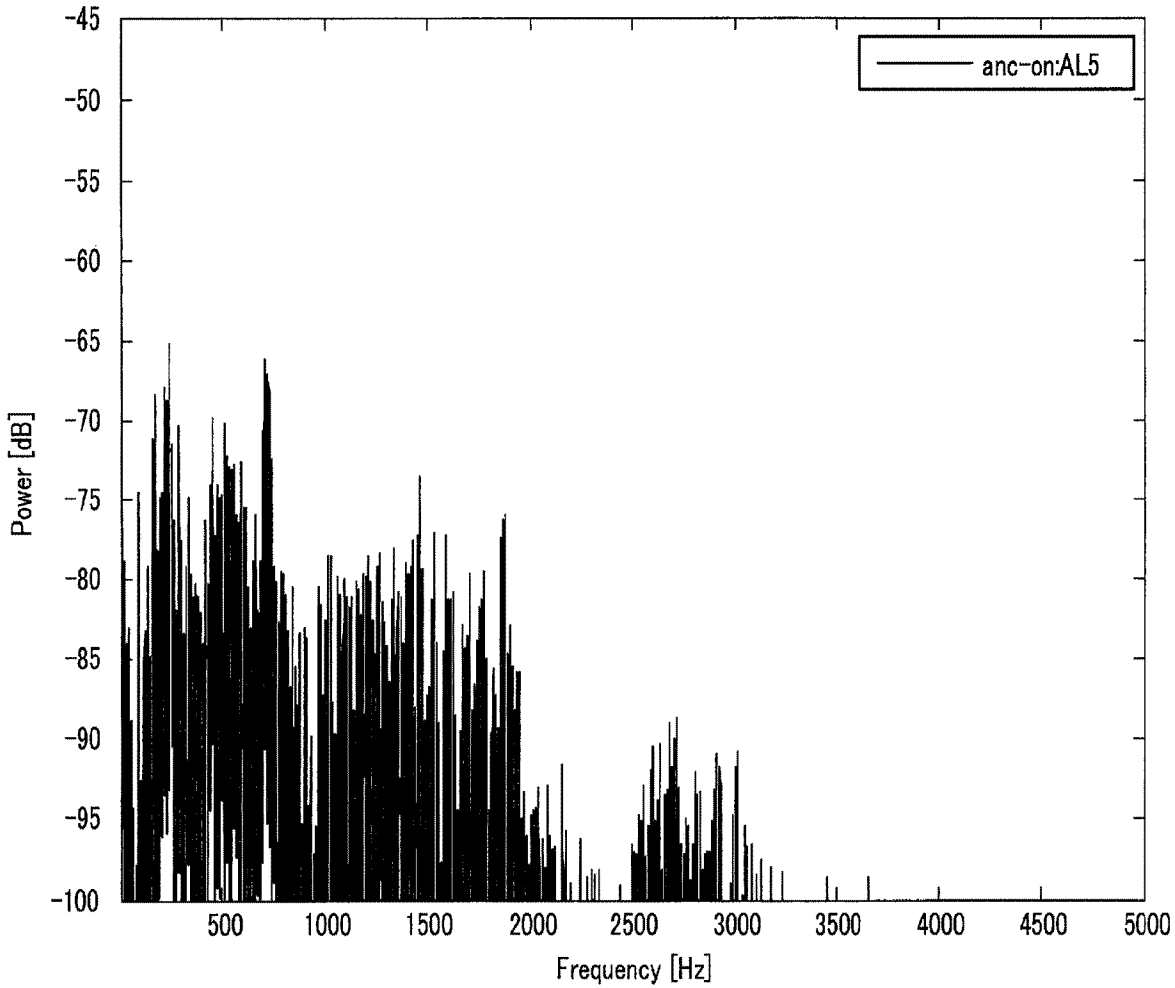
FIG. 13D is a graph showing a frequency characteristic in a period from 9 to 11 seconds in the graph shown in FIG. 12E.
Figure 13E:
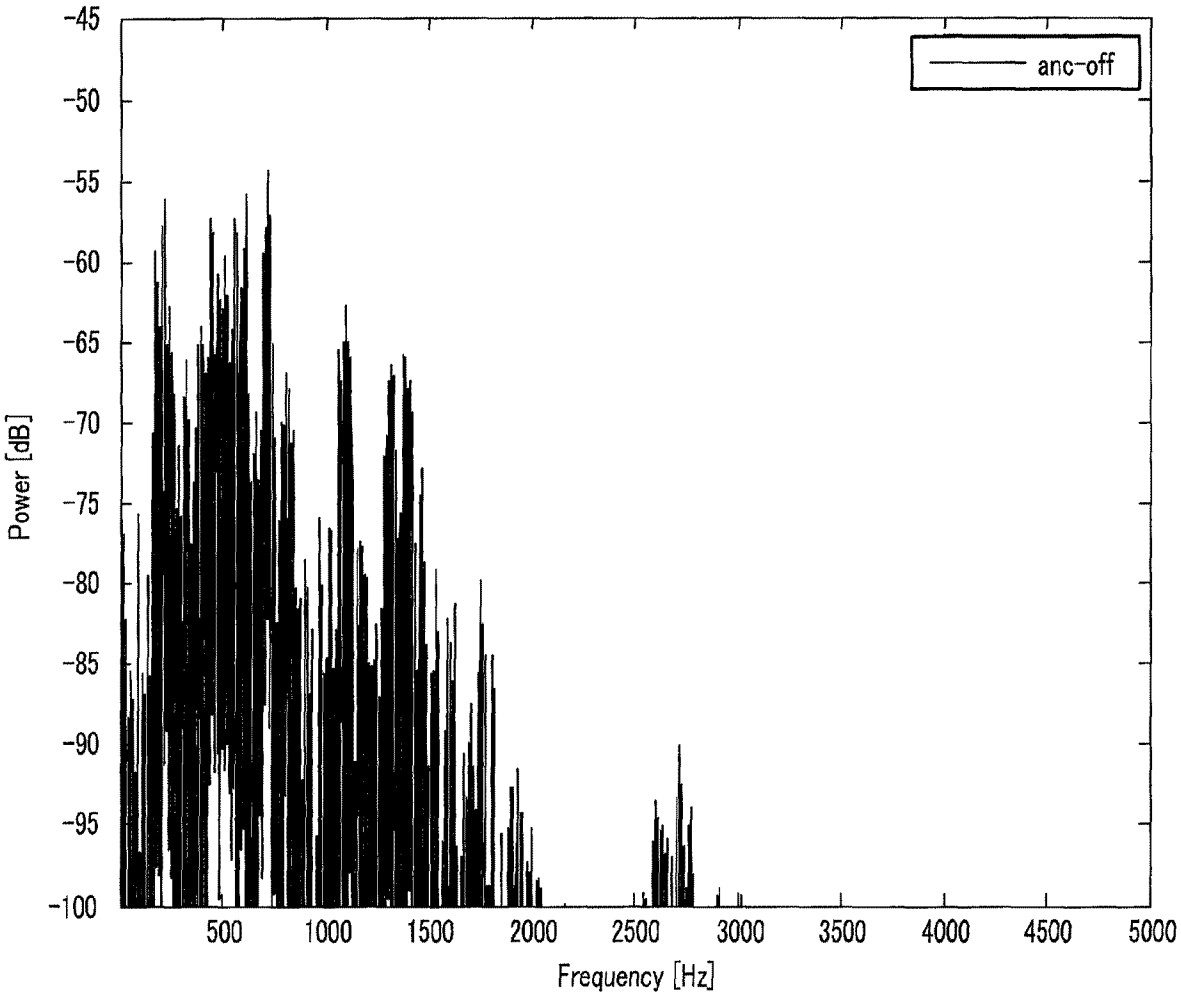
FIG. 13E is a graph showing the frequency characteristic of the noise s2 without noise reduction control.

The control effects will be evaluated next from frequency characteristics. FIG. 13A shows a frequency characteristic in a period from 9 to 11 seconds in FIG. 12B showing the simulation result concerning AL1. FIG. 13B shows a frequency characteristic in a period from 9 to 11 seconds in FIG. 12B showing the simulation result concerning AL3. FIG. 13C shows a frequency characteristic in a period from 9 to 11 seconds in FIG. 12C showing the simulation result concerning AL3*b*. FIG. 13D shows a frequency characteristic in a period from 9 to 11 seconds in FIG. 12E showing the simulation result concerning AL5. FIG. 13E shows a frequency characteristic without any control.

FIGS. 13A and 13B indicate that AL3*b* exhibits a higher control effect than AL1. FIGS. 13C and 13D indicate that control effects obtained by AL3*b* and AL5 are similar to each other and are higher than that obtained by AL1. However, noise in the band from 2.5 kHz to 3 kHz is higher in AL3*b* and AL5 than in AL3, and is higher than that with control OFF. That is, in AL3*b* and AL5, noise in the band from 2.5 kHz to 3 kHz is amplified. Such amplified noise is generated because the contribution ratio of noise in this band is originally low, and the inverse filter characteristic is not accurate.

As is obvious from the above description, when shortening the time before a control effect appears with respect to the MR noise s2, it is preferable to use AL3*b* or AL5, whereas when preventing the amplification of noise in the band from 2.5 kHz to 3 kHz, it is preferable to use AL3.

As described above, for noise with high noise levels throughout the control band like the noise s1, it is preferable to use AL3*b* or AL5 which takes a short time before a control effect appears and exhibits a high control effect. In addition, for noise like the noise s2 in a band with low noise levels in the control band, when shortening the time before a control effect appears, it is preferable to use AL3*b* or AL5, whereas when preventing the amplification of noise in the band with low noise levels, it is preferable to use AL3.

(Modification)

Figure 14:
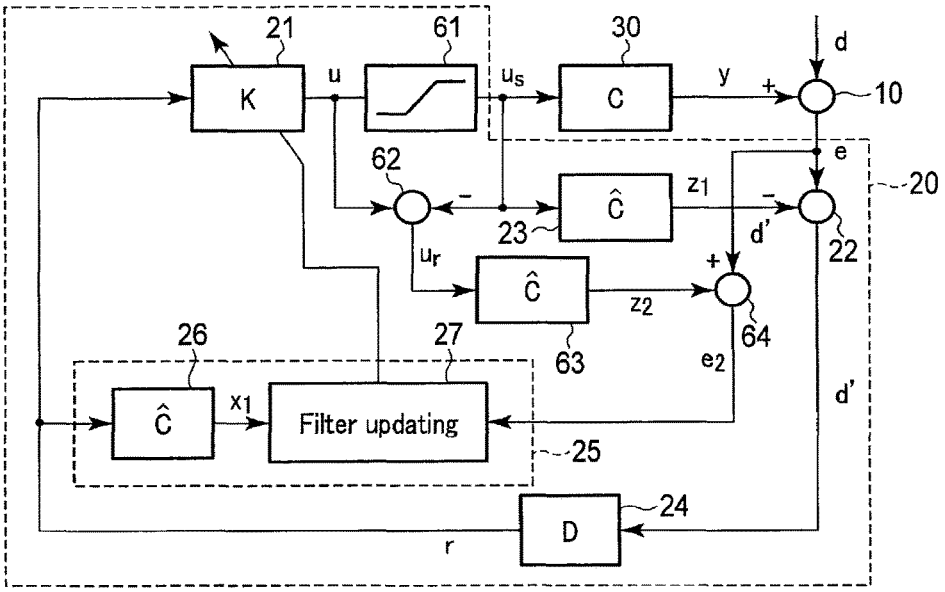
FIG. 14 is a block diagram showing a noise reduction system according to a modification of the embodiment.
Figure 15:
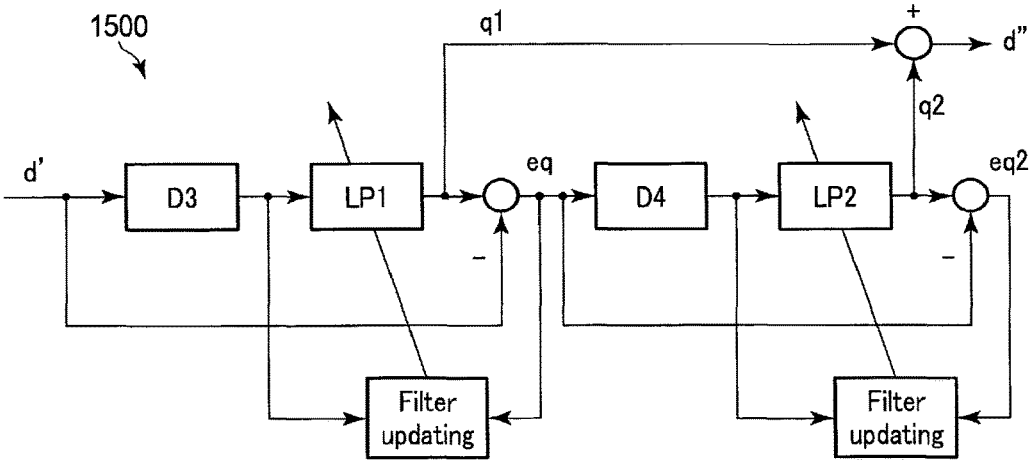
FIG. 15 is a block diagram showing a noise reduction system according to a modification of the embodiment.

Since the volume of MRI noise is high, the error microphone cannot sometimes generate a sufficient sound wave with the same amplitude and the opposite phase from an output from the control loudspeaker. In this case, the input voltage to the loudspeaker reaches the maximum value to cause saturation, resulting in an out-of-control condition. In order to avoid this condition, as shown in FIG. 14, circuitry 61 which suppresses the control signal u to value equal to or less than the allowable input of the control loudspeaker 32 may be provided between the control filter 21 and the loudspeaker unit 30. A signal $u_s$ output from the circuitry 61 is a signal obtained by applying saturation (which is set in consideration of the maximum applied voltage to the loudspeaker) to the control signal u. The signal $u_s$ is input to the loudspeaker unit 30. In this case, an estimated control signal is a signal $z_1$ obtained by converting the signal $u_s$ using the secondary path filter 23. An estimated noise signal is calculated by using the signal $z_1$.

An error signal to be supplied to the filter updating unit 25 is generated as follows. A subtractor 62 generates a signal $u_r$ by subtracting the signal $u_s$ from the control signal u. A secondary path filter 63 generates a signal $z_2$ by converting the signal $u_r$ based on the estimated secondary path characteristic $\hat{C}$. The signal $z_2$ corresponds to a control signal in the error microphone 10 which is not reflected by saturation. An adder 64 generates a signal $e_2$ by adding the signal $z_2$ to the error signal e. The signal $e_2$ is supplied as an error signal to the filter updating unit 25. This enables the filter updating unit 25 to determine that the error signal e has been reduced, and continues updating the control filter 21. When the circuitry 61 is applied to any one of the algorithms shown in FIGS. 4, 5, 6, 7, and 8, it should be noted that the filter updating unit 25 uses the signal $e_2$ in place of the error signal e, and a signal $z_1+z_2$ in place of the signal z.

An MRI device is generally provided with a refrigerating machine which cools the driving coil. The refrigerating machine generates noise separately from noise generated by the MRI device. Noise from the refrigerating machine is different in period from noise from the MRI device itself, and hence may adversely affect control. Circuitry 1500 which removes noise components generated from a noise source (the refrigerating machine in this case) different from the MRI device may be provided between the subtractor 22 and the delay filter 24. The circuitry 1500 removes refrigerating machine noise and the like from an estimated noise signal d'. The circuitry 1500 is a undesired signal removing mechanism including two linear prediction filters LP1 and LP2. The linear prediction filter LP1 acquires short-period noise contained in MRI noise, and outputs a signal q1. A delay element D3 is set to about 20/fs to 200/fs [sec]. The delay element D3 must be set to MTR/2 or less. The linear prediction filter LP2 extracts an impact noise component q2 from a signal eq obtained by subtracting the signal q1 from the estimated noise signal d'. D4 is decided based on an impact noise interval, and is set to about (MTR−150/fs) [sec]. Finally, the signals q1 and q2 are added to acquire an estimated MRI noise d" from which undesired signals such as refrigerating machine noise have been removed. As a method of updating the linear prediction filters LP1 and LP2, NLMS or the like is used. When the circuitry 1500 is applied to any one of the algorithms shown in FIGS. 4, 5, 6, 7, and 8, the circuitry 1500 is provided between the subtractor 22 and the delay filter 24 to handle the signal d" as an estimated noise signal.

Figure 16:
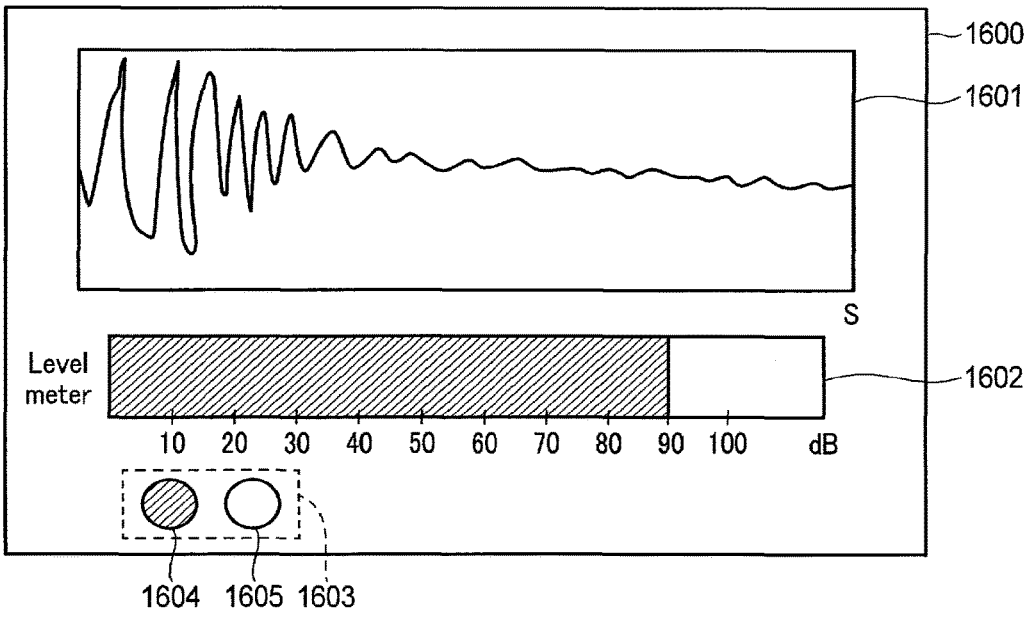
FIG. 16 is a view showing a display screen of an MRI device according to a modification of the embodiment.

The operator operates the console of the MRI device from outside the room in which the main body of the MRI device is installed. For this reason, the operator cannot determine whether the noise reduction system is reducing noise. The noise reduction system may include a notification unit which notifies the operator whether noise is reduced. For example, as shown in FIG. 16, the noise reduction system displays control information on a display screen 1600 of the MRI device. The display screen 1600 includes, for example, an area 1601 for displaying a temporal change in the error signal e, an area 1602 for displaying the current signal level of the error signal e, and an area 1603 for displaying information indicating whether noise is reduced. In the area 1603, for example, an area 1604 is lighted blue when the signal level of the error signal e is less than a threshold, and an area 1605 is lighted red when the signal level of the error signal e is equal to or more than the threshold. This allows the operator to determine whether the noise reduction system is normally functioning.

The noise reduction system according to any one of the embodiments described above can be generally applied to devices which repetitively generate impact noise as well as MRI devices.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A noise reduction system for reducing noise generated from an MRI device and including impact noise repetitively generated at a time interval, the system comprising:

an error signal generator that generates an error signal based on the noise being detected;

an estimated noise generator that generates an estimated noise signal based on the error signal and a first control signal, the estimated noise signal indicating an estimate of a sound pressure of the noise;

a delay signal generator that has a time delay characteristic and delays the estimated noise signal to generate a delay signal, the time delay characteristic being determined based on an imaging sequence or prescanning by the MRI device and the time delay characteristic corresponding to the time interval of the repetitively generated impact noise;

a control filter that generates the first control signal from the delay signal; and a loudspeaker unit including at least one pair of a first filter and a control loudspeaker and a transmission unit, the first filter generating a second control signal from the first control signal, the control loudspeaker converting the second control signal to a sound wave to output a control sound, the transmission unit transmitting the control sound.

2. The system according to claim 1, wherein the loudspeaker unit includes one pair of the first filter and the control loudspeaker, the transmission unit includes a resonance box to which the control loudspeaker is attached, and a tube which is connected to the resonance box and transmits the control sound, and a filter characteristic of the first filter is a through characteristic or an approximate inverse characteristic of a secondary path characteristic indicating a path characteristic from the first control signal to the error signal generator.

3. The system according to claim 1, wherein the loudspeaker unit includes a plurality of pairs of first filters and control loudspeakers, the transmission unit includes resonance boxes to which the control loudspeakers are attached, a sound collection unit which is connected to the resonance boxes via tubes and combines control sounds output from the control loudspeakers to generate a composite control sound, and a tube which is connected to the sound collection unit and transmits the composite control sound, and path characteristics from the control loudspeakers to the error signal generator are different from each other, and the first filter is configured such that a secondary path characteristic indicating a path characteristic from the first control signal to the error signal generator coincides with a target transmission characteristic.

4. The system according to claim 1, wherein a filter characteristic of the control filter is an inverse characteristic of a secondary path characteristic indicating a path characteristic from the first control signal to the error signal generator, and the time delay characteristic is based on a value obtained by subtracting a time not less than a delay of the secondary path characteristic from the time interval.

5. The system according to claim 1, further comprising a filter updating unit including:

a second filter that has an estimated secondary path characteristic based on a result of identifying a secondary path characteristic indicating a path characteristic from the first control signal to the error signal generator, and generates a first auxiliary signal from the delay signal; and an updating unit that adaptively updates the control filter by using the estimated noise signal and the first auxiliary signal, wherein the time delay characteristic is based on a value obtained by subtracting a time not less than a delay of the secondary path characteristic from the time interval.

6. The system according to claim 5, wherein an initial state of the control filter is identical to an inverse filter of the secondary path characteristic.

7. The system according to claim 1, further comprising:

a secondary path filter that has an estimated secondary path characteristic based on a result of identifying a secondary path characteristic indicating a path characteristic from the first control signal to the error signal generator, and generates an estimated control signal indicating an estimate of a sound pressure of the control sound at the error signal generator from the first control signal; and a filter updating unit includes a second filter that has the estimated secondary path characteristic and generates a first auxiliary signal from the delay signal, a third filter that converts the first auxiliary signal in accordance with a filter characteristic identical to a filter characteristic of the control filter, a subtractor that subtracts a signal output from the third filter from the estimated control signal to generate a second auxiliary signal, and an updating unit that adaptively updates the control filter by using the estimated noise signal, the first auxiliary signal, and the second auxiliary signal, wherein the time delay characteristic is based on a value obtained by subtracting a time not less than a delay of the secondary path characteristic from the time interval.

8. The system according to claim 7, wherein an initial state of the control filter is identical to an inverse filter of the secondary path characteristic.

9. The system according to claim 1, wherein the control filter includes an inverse filter that converts the delay signal in accordance with an inverse characteristic of a secondary path characteristic indicating a path characteristic from the first control signal to the error signal generator, and an adaptive filter that generates the first control signal from a signal output from the inverse filter, and the system further comprises a second filter that has an estimated secondary path characteristic based on a result of identifying a secondary path characteristic indicating a path characteristic from the first control signal to the error signal generator d generates a first auxiliary signal from the signal output from the inverse filter, and an updating unit that adaptively updates the control filter by using the estimated noise signal and the first auxiliary signal, wherein the time delay characteristic is based on a value obtained by subtracting a time not less than a delay of the secondary path characteristic and a time not less than a time corresponding to one tap from the time interval.

10. The system according to claim 1, further comprising a secondary path filter that has an estimated secondary path characteristic based on a result of identifying a secondary path characteristic indicating a path characteristic from the first control signal to the error signal generator and generates an estimated control signal indicating an estimate of a sound pressure of a control sound at the error signal generator from the first control signal, wherein the control filter includes an inverse filter that converts the delay signal in accordance with an inverse characteristic of a secondary path characteristic indicating a path characteristic from the first control signal to the error signal generator, and an adaptive filter that generates the first control signal from a signal output from the inverse filter, and the system further comprises a filter updating unit including a second filter that has the estimated secondary path characteristic and generates a first auxiliary signal from a signal output from the inverse filter, a third filter that converts the first auxiliary signal in accordance with a filter characteristic identical to a filter characteristic of the control filter, a subtractor that subtracts a signal output from the third filter from the estimated control signal to generate a second auxiliary signal, and an updating unit that adaptively updates the adaptive filter by using the estimated noise signal, the first auxiliary signal, and the second auxiliary signal, and the time delay characteristic is based on a value obtained by subtracting a time not less than a delay of the secondary path characteristic and a time not less than a time corresponding to one tap from the time interval.

11. The system according to claim 1, further comprising circuitry provided between the control filter and the loudspeaker unit and configured to suppress the first control signal to not more than an allowable input of the control loudspeaker.

12. The system according to claim 1, further comprising circuitry configured to remove a noise component generated from a noise source different from the MRI device from the estimated noise signal.

13. The system according to claim 1, further comprising a notification unit that notifies information indicating whether the noise is reduced.

* * * * *